US007279659B2

(12) United States Patent
Gagas et al.

(10) Patent No.: US 7,279,659 B2
(45) Date of Patent: Oct. 9, 2007

(54) NON-FOOD WARMER APPLIANCE

(75) Inventors: John M. Gagas, Milwaukee, WI (US); Daniel E. Stair, II, Cedarburg, WI (US); David J. Zeier, Town of Delafield, WI (US)

(73) Assignee: Western Industries, Inc., Milwaukee, WI (US)

( * ) Notice: Subject to any disclaimer, the term of this patent is extended or adjusted under 35 U.S.C. 154(b) by 0 days.

(21) Appl. No.: 11/216,314

(22) Filed: Aug. 31, 2005

(65) Prior Publication Data

US 2006/0049172 A1 Mar. 9, 2006

Related U.S. Application Data

(60) Provisional application No. 60/622,185, filed on Oct. 26, 2004, provisional application No. 60/606,396, filed on Sep. 1, 2004.

(51) Int. Cl.

| | |
|---|---|
| ***F27D 11/00*** | (2006.01) |
| ***F27D 11/02*** | (2006.01) |
| ***F27D 1/18*** | (2006.01) |
| ***F27D 19/00*** | (2006.01) |
| ***F26B 19/00*** | (2006.01) |
| ***F23M 7/00*** | (2006.01) |

(52) U.S. Cl. ..... 219/400; 219/385; 219/392; 219/407; 219/521

(58) Field of Classification Search ..... None
See application file for complete search history.

(56) References Cited

U.S. PATENT DOCUMENTS 2,957,067 A * 10/1960 Scofield ..... 219/400
3,958,552 A * 5/1976 Lawler ..... 126/247
3,978,238 A 8/1976 Frey et al.
4,039,776 A 8/1977 Roderick
4,298,789 A * 11/1981 Eichelberger et al. ..... 219/406
4,345,143 A 8/1982 Craig et al.
4,439,459 A 3/1984 Swartley
4,444,175 A 4/1984 Reynolds (Continued)

OTHER PUBLICATIONS

Gagas et al., U.S. Appl. No. 11/216,443, titled "Warming Apparatus", filed on Aug. 31, 2005 (Specification, Claims and Abstract 44 pgs., 16 pgs. of drawing, 60 total pgs.).

(Continued)

*Primary Examiner*—Joseph Pelham
(74) *Attorney, Agent, or Firm*—Boyle Fredrickson

(57) ABSTRACT

A non-food warmer apparatus includes an enclosure having sides, a top, and a bottom defining a chamber. A drawer structure has a support member to support objects. The drawer structure is coupled to the enclosure for movement between a retracted position to warm the objects within the chamber and an extended position external to the chamber to permit access to the objects by a user. A heating system heats the chamber and a ventilation system moves air through the chamber. A user interface includes inputs to control a temperature and a humidity within the chamber. A detection system includes sensors to detect a condition within the chamber and provide a signal. An electronic control system is coupled to the enclosure and interfaces with the heating system, the ventilation system, the user interface, and the detection system so the objects in the chamber can be maintained at a desired temperature.

39 Claims, 11 Drawing Sheets

U.S. PATENT DOCUMENTS

| | | | | | |
|---|---|---|---|---|---|
| 4,468,424 | A | | 8/1984 | Cartwright | |
| 4,503,760 | A | | 3/1985 | Pryputsch et al. | |
| 4,622,231 | A | | 11/1986 | Swartley | |
| 4,751,368 | A | | 6/1988 | Daifotes | |
| 4,751,911 | A | | 6/1988 | Betts et al. | |
| 4,918,290 | A | * | 4/1990 | DeMars | 219/400 |
| 4,927,995 | A | * | 5/1990 | Lovett et al. | 219/385 |
| 4,980,539 | A | | 12/1990 | Walton | |
| 5,086,752 | A | | 2/1992 | Hait | |
| 5,101,714 | A | * | 4/1992 | Grandi | 99/335 |
| 5,233,969 | A | | 8/1993 | Koledin | |
| 5,365,039 | A | | 11/1994 | Chaudoir | |
| 5,369,892 | A | * | 12/1994 | Dhaemers | 34/275 |
| 5,417,148 | A | | 5/1995 | Cavallo | |
| 5,466,058 | A | | 11/1995 | Chan | |
| 5,619,613 | A | | 4/1997 | Otaki | |
| 5,676,051 | A | | 10/1997 | Sinemus | |
| 5,694,835 | A | * | 12/1997 | Mangina | 99/468 |
| 5,783,803 | A | | 7/1998 | Robards, Jr. | |
| 5,873,300 | A | | 2/1999 | Kuhlman | |
| 5,900,173 | A | | 5/1999 | Robards, Jr. | |
| 5,948,301 | A | | 9/1999 | Liebermann | |
| 6,005,227 | A | * | 12/1999 | Pappas | 219/400 |
| 6,007,689 | A | * | 12/1999 | Renfrew et al. | 204/470 |
| 6,041,773 | A | | 3/2000 | Rosenquist | |
| 6,108,486 | A | | 8/2000 | Sawabe et al. | |
| 6,111,224 | A | | 8/2000 | Witt | |
| 6,116,154 | A | | 9/2000 | Vaseloff | |
| 6,121,583 | A | * | 9/2000 | Hansen | 219/401 |
| 6,124,572 | A | | 9/2000 | Spilger et al. | |
| 6,166,353 | A | | 12/2000 | Senneville et al. | |
| 6,191,391 | B1 | | 2/2001 | Deo et al. | |
| 6,259,067 | B1 | | 7/2001 | Faries, Jr. et al. | |
| 6,265,695 | B1 | | 7/2001 | Liebermann | |
| 6,376,805 | B2 | * | 4/2002 | Faries et al. | 219/400 |
| 6,384,380 | B1 | | 5/2002 | Faries, Jr. et al. | |
| 6,414,283 | B1 | | 7/2002 | McNamara | |
| 6,437,291 | B1 | * | 8/2002 | Hopponen | 219/395 |
| 6,484,512 | B1 | * | 11/2002 | Anderson et al. | 62/3.2 |
| 6,523,458 | B1 | | 2/2003 | Turner | |
| 6,525,298 | B1 | * | 2/2003 | Hunts | 219/400 |
| 6,612,116 | B2 | | 9/2003 | Fu et al. | |
| 6,660,974 | B2 | * | 12/2003 | Faries et al. | 219/400 |
| 6,693,260 | B1 | * | 2/2004 | Rodrigues | 219/385 |
| 6,713,733 | B2 | * | 3/2004 | Kochman et al. | 219/549 |
| 6,849,835 | B2 | * | 2/2005 | Bollmers et al. | 219/520 |
| 6,982,399 | B1 | * | 1/2006 | Hunts | 219/400 |
| 2001/0039884 | A1 | * | 11/2001 | Backus et al. | 99/421 H |
| 2004/0026946 | A1 | * | 2/2004 | Reed et al. | 296/24.3 |
| 2004/0188409 | A1 | * | 9/2004 | Faries et al. | 219/400 |
| 2005/0178757 | A1 | * | 8/2005 | Starr et al. | 219/386 |
| 2005/0211696 | A1 | * | 9/2005 | Adamski | 219/400 |
| 2006/0027556 | A1 | * | 2/2006 | Peterson et al. | 219/386 |

OTHER PUBLICATIONS

Wolf, Warming Drawer Use & Care Information, bearing a date indication of Jan. 2004; 16 pgs.

Wolf, Warming Drawer Installation Instructions, bearing a date indication of Nov. 2004; 12 pgs.

Gagas, John M., U.S. Appl. No. 11/147,511 titled Factory Preset Temperature Warming Appliance; filed on Jun. 8, 2005.

* cited by examiner

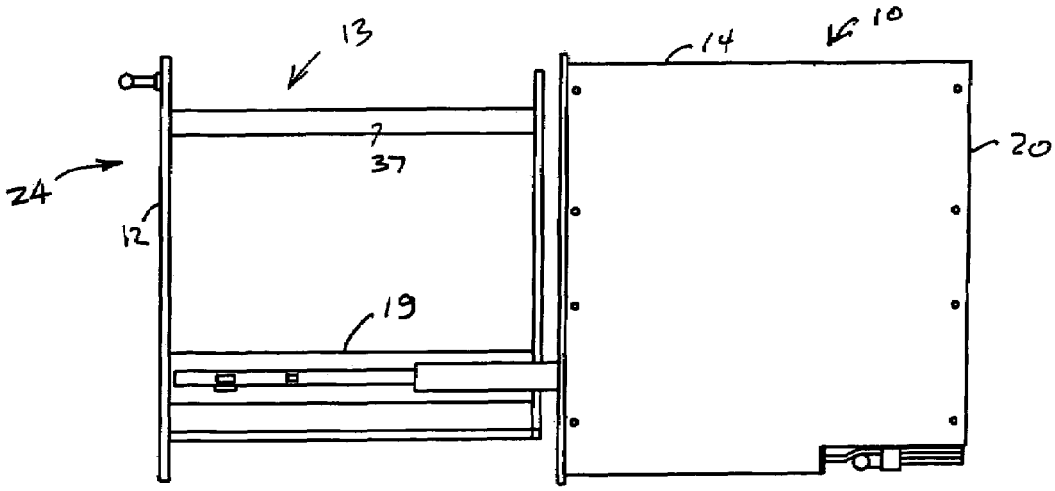
FIG. 1
FIG. 2
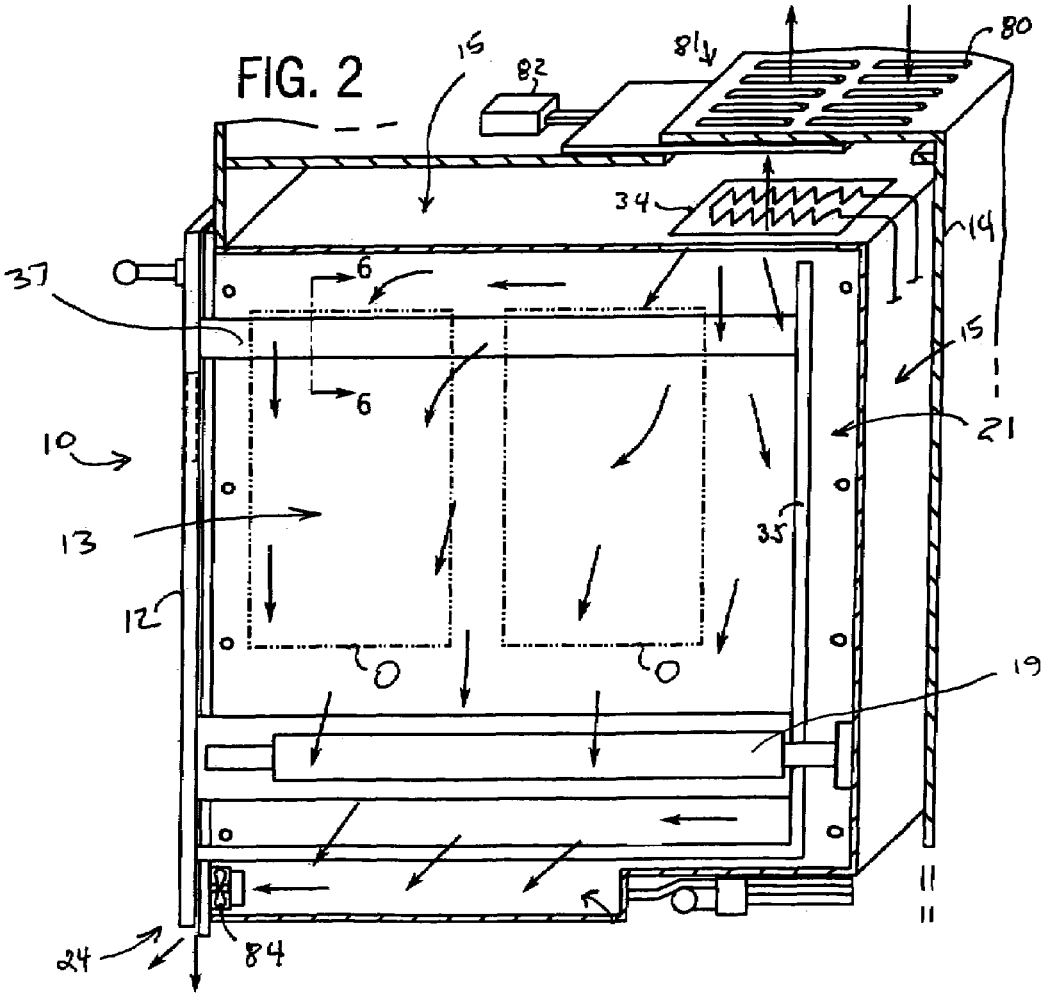

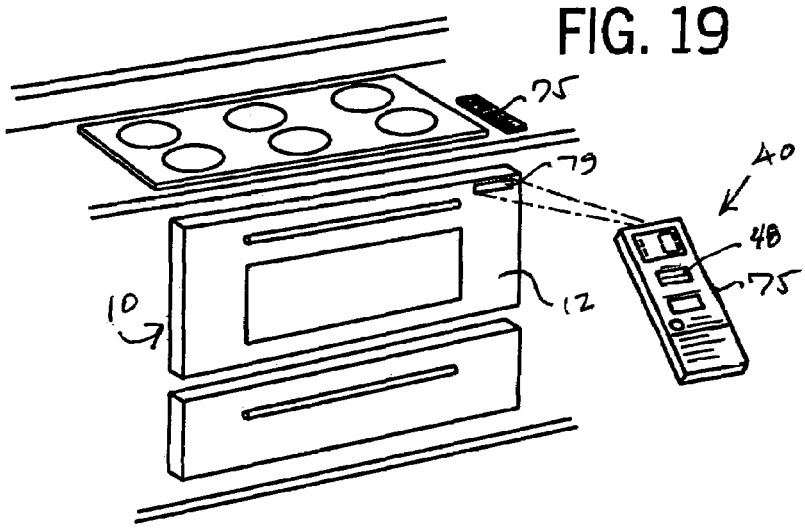
FIG. 19
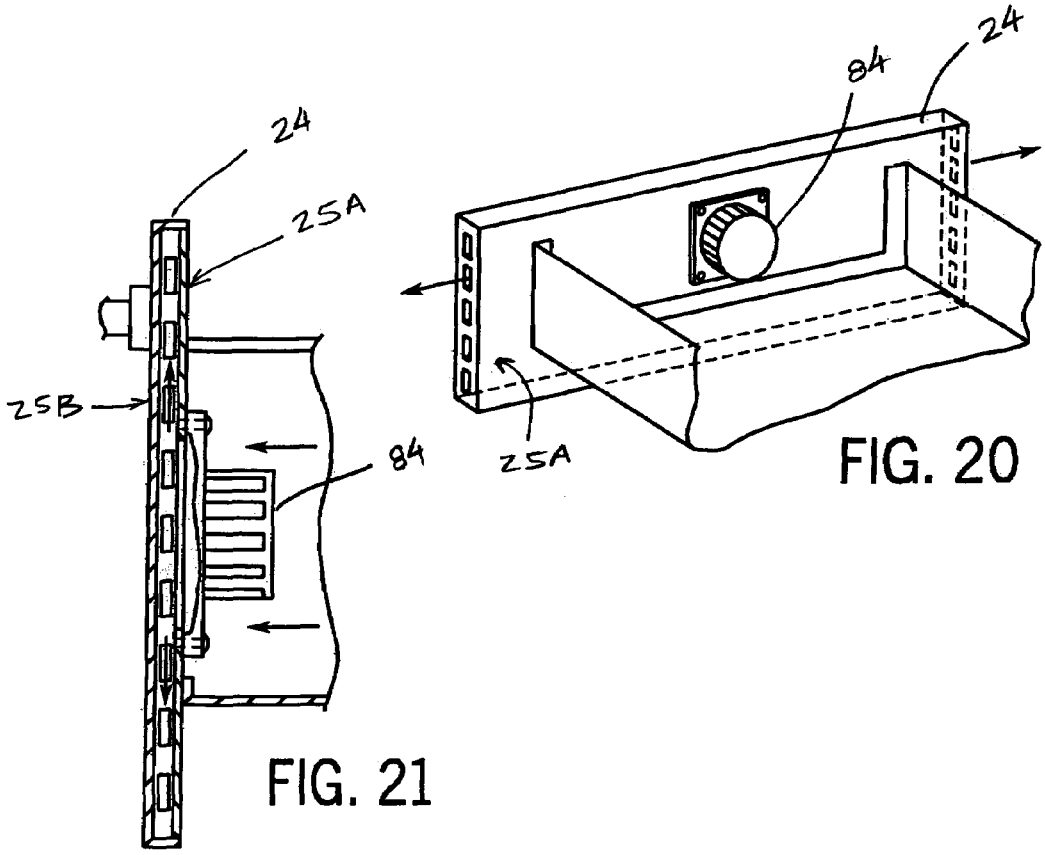
FIG. 20
FIG. 21

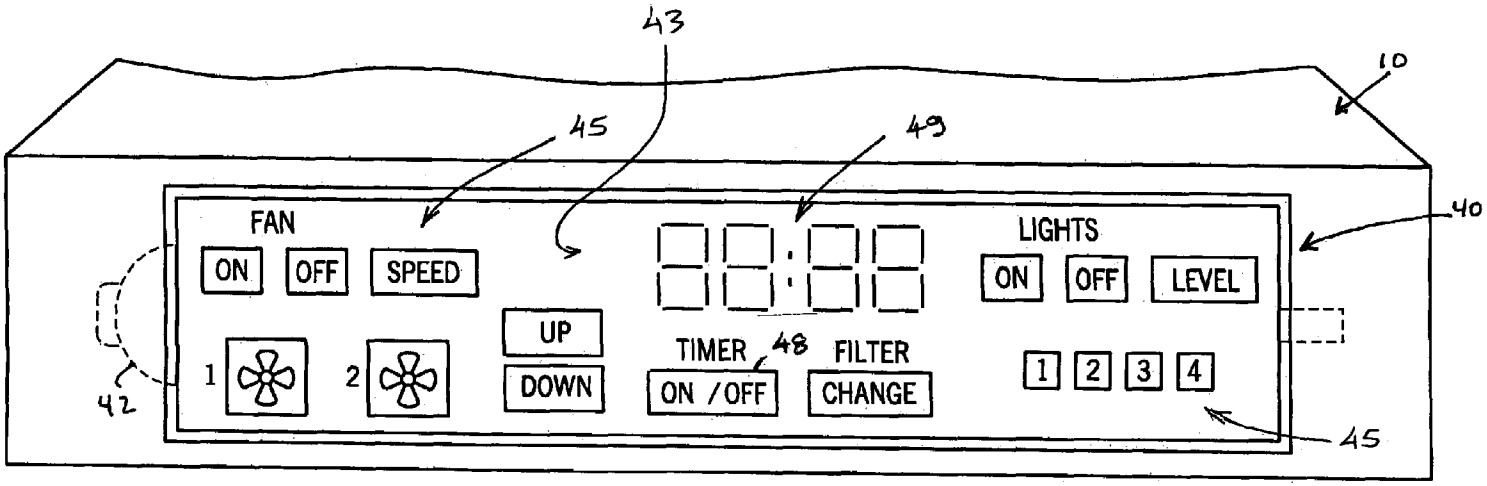
FIG. 22
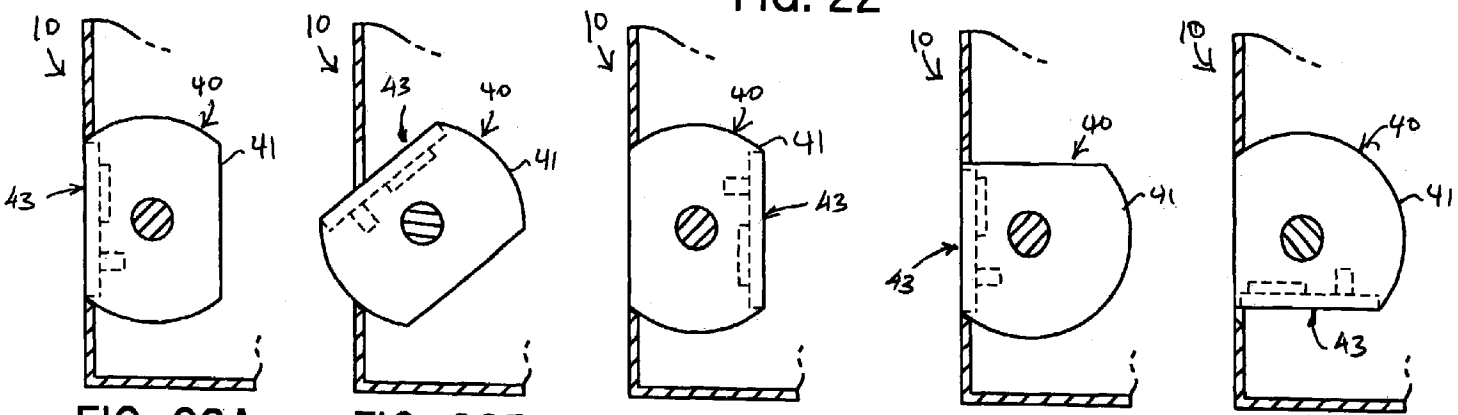
FIG. 23A
FIG. 23B
FIG. 23C
FIG. 24A
FIG. 24B

NON-FOOD WARMER APPLIANCE

CROSS-REFERENCE TO RELATED PATENT APPLICATIONS

This Application claims the benefit of priority under 35 U.S.C. § 119(e) of U.S. Provisional Patent Application No. 60/606,396 titled "Warmer Drawer" filed on Sep. 1, 2004, and U.S. Provisional Patent Application No. 60/622,185 titled "Non-Food Warmer Drawer" filed on Oct. 26, 2004 which are incorporated herein by reference in their entirety.

FIELD

The present invention relates to warming appliances, and more particularly to non-food warming appliances. The present invention relates more particularly to a non-food warmer drawer.

BACKGROUND

Non-food warming drawers such as towel warmer drawers of conventional design are typically constructed as closed boxes of single wall or double wall construction with insulation or air in between, with front doors providing access to a sliding drawer horizontally aligned to access non-food items or objects (such as towels, robes, dishes, restaurant-ware, etc.) within the interior of the box. The front door(s) are often fixed in a vertical plane. Heating of the interior of the box is usually accomplished by a single cal rod (sheathed heating element), axial fan heaters, hot water, oil heat, or contact type heaters. The heat sources are typically arranged to conduct heat across an item in the drawer with the use forced air arrangements (such as a heater/fan or heater-blower combination) or by radiant heat arrangements where heat is radiated upwards from a heated pipe or a cal rod as a way to warm the interior of the box and to warm the non-food objects, such as towels, inside the box. However, warmer drawers for non-food objects that use such forced air methods in a closed chamber tend to have certain disadvantages. For example, a forced air heater/fan combination having a heating element in front of the fan and blowing hot air inside the enclosure tends to cause the heating element to continually heat up and draw excessive electrical current. In such arrangements, the heater usually receives only internal air as supplied by the fan and the heater remains in a mode of high output. The resulting high temperature is typically directed at the top or sides of the objects often causing hot spots that can burn the objects (such as heat sensitive objects such as towels and the like). The forcing of the air into the chamber also tends to result in air moving past the object without sufficiently warming the objects. In addition, direct contact with the heating element, if not shielded, can cause overheating, discoloration or burning of the objects. Further, in the event that the fan should stop or if air is somehow restricted, the fan can fail due to overheating, which may result in a "runaway" heating element. Accordingly, such conventional arrangements often require that a "fail-safe" type switch must be added which elevates the cost of the non-food warmer drawer.

According to other conventional designs, towel warmers with generally "airtight" enclosures have also been used. The airtight chambers typically use only the air inside the box, re-circulating it and heating (or reheating) the re-circulated air. However, these type of airtight chambers have certain disadvantages. For example, temperature overshoot and undershoot problems from the heating elements typically occur, resulting in temperatures within the airtight chambers that are too high and cause objects within the chamber such as towels to become too hot and discoloring (e.g. heat discoloration, scorching, burning, etc.). In order to protect the towels, many attempted solutions to reduce the temperature within the chambers have been used, but have not resulted in a satisfactory solution. In addition, the air within the airtight chambers poses other detrimental issues for the user. For example, because such warmers generally do not exhaust the heated air, any odor or smell from the objects tends to remain within the enclosure and adversely affect other objects. In some cases the smell may be so strong that the use of warmed objects such as towels becomes undesirable.

Other conventional non-food warmer drawers use a "pan" type of arrangement with a heating element (such as cal rod or the like) below the pan. However, such a conventional non-food warmer drawer design is essentially converting a conventional food warmer drawer to a non-food warmer application, which also tends to suffer from certain disadvantages. For example, when heating non-food objects such as towels, these pan-type warmer drawers tend to result in only the bottom of the towel getting warm and usually do not provide a desired uniform heating of the object(s). In some instances, before the towel's inside surfaces can be warmed, the exposed outer surfaces may burn or suffer other types of degradation associated with exposure to high temperature. In some conventional pan-type applications, a plate has been added within the box in an attempt to defuse the heat and prevent burning of the object(s). However, this purported "fix" usually only slows the warming of the object(s), which results in the object(s) needing to be in the pan for a longer period of time. When warming objects such as towels, the thermal energy necessary to penetrate the towel folds is a generally known problem with the use of pan (or shelf) type warmer drawers. Typically, when warming a stack of objects such as towels, as the "stack" of towels in the warmer drawer increases, the amount of thermal energy needed to heat towels to the desired level also increases.

The conventional non-food warmer drawers also suffer from other disadvantages. For example, the sensors used to detect the temperature of the objects in the warmer drawers are typically capillary tube device or the like, in which expanding gases within the tube, as temperature increases or decreases, transfers force or relaxes force to a mechanical switch, causing the switch to close or open for supplying electrical current to, or turning current off, to the cal rod or axial fan. The typical response time for these types of controls tends to be undesirably slow and often results in overshoots and undershoots in temperature. These characteristic temperature ranges and swings in conventional non-food warmer drawers, from power on and off cycling, tend to result in such conventional warmer drawers being designed to provide lower temperatures and longer times needed for warming of the objects (particularly for heat sensitive objects such as towels and the like). In addition, the undershoot of the temperature usually results in the user does not obtaining a desired temperature for the object. Thus the desired effects of receiving a properly warmed object, such as a warm towel to the skin and the ability to drive moisture out of a towel are reduced.

The conventional non-food warmer drawers also tend to suffer from certain other disadvantages. For example, certain conventional non-food warmer drawers often locate the heating elements with a combined fan (heater/blowers) on the top and sides of the warming chamber, and provide a cal rod (used in varying patterns) in the bottom of the box to provides radiant heat. The radiant heat tends to rise slowly, warming from the bottom to the top of the chamber. This radiant heat usually produces "hot spots" when reaching a pan or plate positioned above it. Such temperature hot spots are generally due to the radiant heat source being strongest (hottest) near the cal rod and decreasing in temperature as distance away from the cal rod increases.

The conventional non-food warmer drawers also tend to suffer from certain other disadvantages. For example, varying temperature levels within the box tend to cause difficulty in controlling and maintaining the temperature of the object. In some instances, temperature stratification or "layering" prevents even and uniform heating of the objects. In addition, startup times to attain the desired temperature in the box can be long due in part to the cal rod design. For example, too much heat too fast and the bottom of a heat sensitive object such as a folded towel will burn before the other parts of the towel reach the desired temperature. The conventional warmer drawers usually attempt to compensate for such problems by providing longer startup times. However, these long startup times generally prevent a user from simply "turning the warmer drawer on", inserting a towel, and achieving an acceptably warm object in a reasonably short period of time. These conventional warmer drawers usually rely on startup times that are undesirably long in an effort to stabilize the temperature inside the box and bring the objects to a safe temperature without overheating. These types of conventional warmer drawers depend on the user accepting undesirably long startup times before using the object. If rushed, the object may not reach a desirable temperature and it can feel unacceptably cool to the touch. Further, as the cal rod cycles, temperature overshoots and undershoots typically result in the temperature on the object being too warm or too cool (depending on when the object is retrieved from the box).

The conventional non-food warmer drawers also tend to suffer from certain other disadvantages. For example, many conventional warmers drawers use knobs and slides to "set" and control mechanical switches for selecting the temperature for the objects. Such mechanical switches tend to have undesirable inaccuracies in their setting and the repeatability of a setting. The disadvantages of such mechanical switches tend to be due in part to the design of the non-food warmer drawer and method of heating, but also due to the inherent inaccuracy of the mechanical switches themselves. Mechanical control switches generally exhibit hysteresis, which contributes to inaccuracies in the ability of the control device to obtain a set point or repeat a function. For example, this can be seen in some conventional warmer drawers by turning the control switch to the right and stopping at a set point; then for comparison, turn the same mechanical switch past the desired set point and then turn the control to the left stopping at the set point. Both actions end with the same set point indicated on the switch but the resulting temperature in the box is often different. The inherent inaccuracies with the mechanical switching devices and controls tends to exacerbate the effects of temperature overshoots and undershoots and the resulting temperature variations experiences by the object. In order to compensate for (or mask) such inaccuracies, many conventional warmer drawers apply control selections that indicate low, medium, and hot (or the like), rather than a specific temperature setting. In such applications, a user generally cannot see the set point differences from one use to the next and may wonder why one day the object is warm and then another day the object is cool when presumably using the same selected settings. Temperature swings as much as 30 degrees or more are believed to occur in such instances have been seen and detract from the ability to provide accurate, rapid and uniform heating of non-food objects.

The conventional non-food warmer drawers also tend to suffer from certain other disadvantages. For example, conventional warmer drawers are typically designed for "built-in" installations, such as to cabinetry, or to a wall, or into another appliance, which tends to limit the available uses for the warmer drawer. The conventional warmer drawers generally do not permit usage as a freestanding unit, or as a mobile unit, or under a cabinet (e.g. suspended or the like), or in areas that do not have the ability to support a structural frame.

Therefore a need exists for a non-food warmer drawer in which more accurate and controlled heating of objects (e.g. towels, restaurant ware, etc.) is accomplished. There also exists the need for an accurate method of controlling the operations and settings of the non-food warmer drawer. There also exists a need for the controls of the non-food warmer drawer to be less susceptible to environmental influences. There also exists a need for a display device to permit a user to be able to view/see the operation, temperature indication(s), set point functions, and view of the contents of the chamber. There also exists a need for a non-food warmer drawer capable of remote control operation. There is a further need to accurately apply and control heat within the chamber of the non-food warming drawer. There is also needed for a non-food warmer drawer such that it can be used in any desirable location to suit the particular needs of a user.

Accordingly, it would be desirable to provide a non-food warming appliance such as a non-food warmer drawer, with any one or more of these or other advantageous features.

SUMMARY

The present invention relates to a non-food warming appliance having an enclosure defining a chamber and a heating apparatus to change the temperature inside the chamber. A support structure supports a non-food object inside the chamber and a user interface associated with the enclosure controls at least the heating apparatus. A control system interfaces with the heating apparatus and user interface, and operates to control the heating apparatus in response to a signal from the user interface so that a non-food object supported by the support structure in the chamber is maintained at a pre-determined temperature.

The present invention also relates to a non-food warmer apparatus with an enclosure defining a chamber and having an opening and a drawer structure extendable from the chamber and movably coupled to the enclosure by guide members. At least one support structure is coupled to the drawer structure to hold non-food objects within the chamber. A heating element provides heat to the chamber and a ventilation system operates to move air within the chamber. At least one sensor provides a signal representative of a condition within the chamber and a user interface receives an input from a user and generates an output. An electronic control system receives the signal representative of a condition within the chamber and the output from the user interface and controls operation of the heating element and the ventilation system.

The present invention further relates to a non-food warmer apparatus having an enclosure having sides, a top, and a bottom defining a chamber. A drawer structure has a support member to support objects. The drawer structure is coupled to the enclosure for movement between a retracted position to warm the objects within the chamber and an extended position external to the chamber to permit access to the objects by a user. A heating system heats the chamber and a ventilation system moves air through the chamber. A user interface includes inputs to control a temperature and a humidity within the chamber. A detection system includes sensors to detect a condition within the chamber and provide a signal. An electronic control system is coupled to the enclosure and interfaces with the heating system, the ventilation system, the user interface, and the detection system so the objects in the chamber can be maintained at a desired temperature.

BRIEF DESCRIPTION OF THE DRAWINGS

FIG. 1 is a side view of an exemplary embodiment of a non-food warming appliance configured as a warmer drawer, with a door extended from an enclosure, the drawer including a rail hanger support, structure.

FIG. 2 is a side sectional view of the non-food warming appliance illustrated in FIG. 1 with the drawer (including to objects to be warmed) in the enclosure chamber and illustrating an exemplary air flow through the warmer drawer.

FIG. 19 is a perspective view of an exemplary embodiment of a non-food warming appliance associated with another appliance and controllable remotely with a remote control unit.

FIG. 20 is a partial perspective view of an exemplary embodiment of a non-food warming appliance illustrating alternative venting from the cavity. (arrows depict air flow.)

FIG. 21 is a side view of the venting illustrated in FIG. 20.

FIG. 22 is an illustration of an exemplary embodiment of a user interface for a non-food warming appliance.

FIGS. 23A-23C are partial side views of a rotating display for the user interface touch control panel illustrated in FIG. 22.

FIGS. 24A-24B are partial side views of an alternative rotating display for the user interface touch control panel illustrated in FIG. 22.

DETAILED DESCRIPTION

Figure 3:
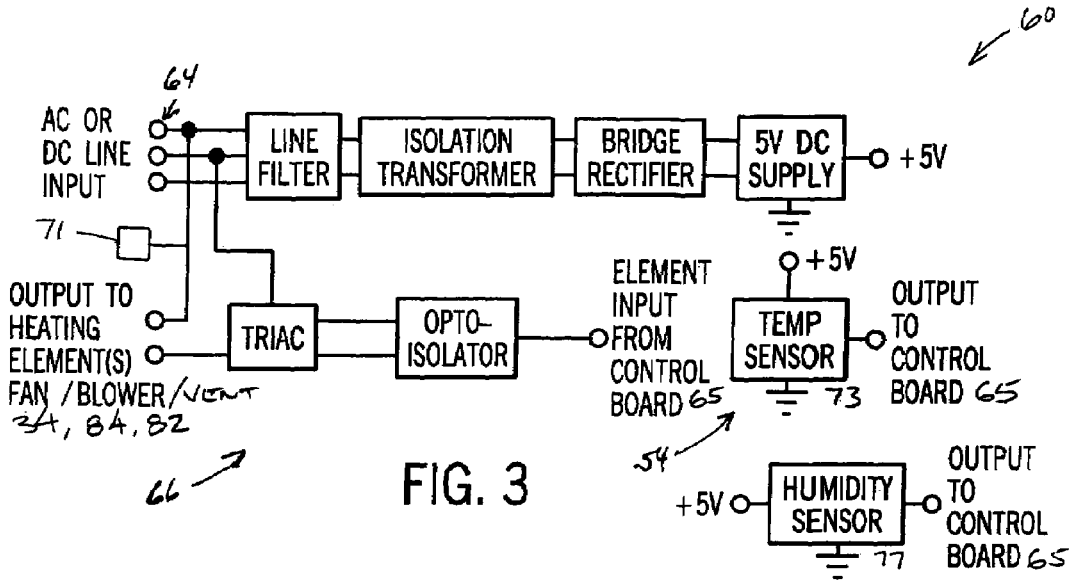
FIG. 3 is a block diagram of an exemplary embodiment of a power circuit for a non-food warming appliance having an electronic controller and including a humidity control circuit and sensor.

According to the illustrated embodiments, there is disclosed a warming apparatus (shown and described as a non-food warmer drawer 10) controlled by an electronic control system to provide improved chamber temperature control, rapid heat-up, improved temperature set point repeatability and minimal temperature variation from a desired set point. The electronic control system of the warmer drawer is shown to interface with (among others) a detection system having various sensors (e.g. temperature, humidity, infrared, scanners, electrical current, etc.), a heating element(s), a ventilation system, a display device and a user interface to enable a wide variety of desirable and advantageous features. For example, the warmer drawer is shown as a modular device that is adaptable for use in a wide variety of locations and environments and with other appliances, fixtures or structures. The warmer drawer (when in use) is intended to use a continuously adjustable amount of power in a heating element to maintain a more precise control of temperature within the chamber (rather than conventional and less-precise "on-off" type devices, however, the electronic control system could be configured for use with conventional heating elements and sensors to reduce swings in temperature). The warmer drawer is also shown to include a ventilation system that may be actuated by various technologies to regulate the flow of air, heat and/or moisture throughout the chamber. The warmer drawer is also shown to include a display device configured to display information to a user related to operation, temperature, functions, times or other control parameters for the warmer drawer. The display device is configured to display text (stationary or scrolling) and graphic images or illustrations. The warmer drawer is also shown to include a user interface (locally controlled and/or remote-controlled) to facilitate operation (e.g. selection of inputs, setting changes, start, stop, hold, etc.) of the warmer drawer by a user. The warmer drawer is further shown to have a temperature-controlled internal chamber that is accessible by access through a door or panel (e.g. "reach-in" etc.) or by a movable portion (e.g. movable holder, extendable portion, drawer, etc. configured to hold objects within the temperature controlled environment of the chamber) that is extendable from, and retractable to, the chamber (in a manually-operated or power-operated manner). The warmer drawer is also capable of use in attaining and maintaining a desired temperature(s) for a wide variety of non-food objects (e.g. plates, towels, garments, etc.). Accordingly, all such features are within the scope of this disclosure. However, this description is not intended to be limiting and any variations of the subject matter shown and described may be made by those of ordinary skill in the art and are intended to be within the scope of this disclosure.

Referring to the Figures, a non-food warming appliance 10 (hereinafter also referred to as a "warmer drawer 10") is comprised of an enclosure 20 defining a chamber. The chamber can be made of stainless steel, plastic, coated metal, glass, ceramic or other metal or non-metal materials or combination of such materials and can be of a decorative nature. According to the illustrated embodiments, the chamber is not intended to be airtight, and is provided with suitable passageways (e.g. air inlet, air exhaust, etc.) to foster a desired air flow pattern within the chamber.

The warmer drawer 10 is shown to include a cabinet 14, along with a top and sides, a bottom, and a back (e.g. "wrapper" etc.), all which comprise the outer enclosure 20. A cabinet having a single wall construction may be used in applications where the surrounding surfaces can accommodate the heat loss, or a double wall cabinet construction (shown to include an inner cabinet walls 15 having an insulating material or airspace between the walls) to minimize heat loss to the external surrounds of the warmer drawer. The inner cabinet walls 15 defines an interior space or cavity (shown as a chamber 21) and includes a bottom, sides, top and back. A drawer structure 13 (e.g. movable holder, extendable portion, etc.) is extendably and retractably located within the chamber 21 and is shown to include an access cover assembly 24, drawer guide members 19, object support members 37 and a rear panel 35. The warmer drawer 10 is also shown to include a heat source such as one or more heating element(s) 34 (note: a shield may be provided in the cabinet to provide heat protection from the heat source). A panel 24 (which may be in the form of one or more doors 12) provides access to the chamber 21 of the cabinet 14.

Although only several possible constructions for the warmer drawer cabinet have been described, there are many ways to construct a warmer drawer cabinet according to alternative embodiments. For example, the chamber can be expanded and configured for a wide variety or quantity of objects, or for containment of certain specific items having a particular size, shape or warming configuration. By further way of example, the cabinet 14 can be expanded horizontally or vertically and devices for holding objects (such as hanger(s) described below) could be added to a larger chamber that could have one drawer with one door front 12, or two or more door fronts 12 and two or more drawers. According to another example, vertical expansion of the warmer drawer may accommodate multiple inverted hangers within an enlarged cavity, or multiple drawer structures in a single large cavity, or multiple drawers, or multiple cavities arranged in a "stacked" orientation. In addition, one or more heating elements 34 could be provided for proper heating. A non-food warmer drawer could be made with one drawer 10 and one door, or it could be designed to have two or more drawers and two or more doors, or any combination of doors and drawers, and in any desirable shape and size (e.g. tall and narrow, short and wide, square, rectangular, etc.). (See FIGS. 11-13, and 15).

Figure 6:
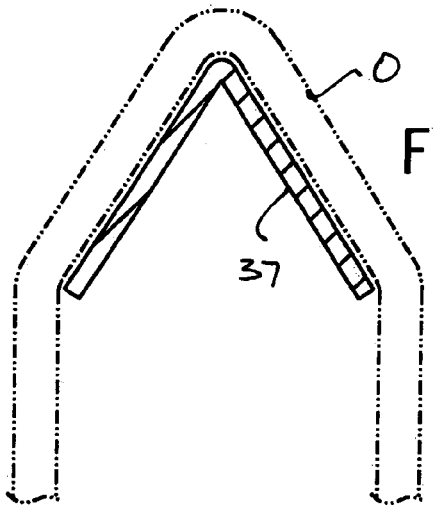
FIG. 6 is a partial front view of an exemplary embodiment of an inverted "V" shaped rail hanger support structure for a non-food warming appliance, with a cloth, for example, a towel, draped over the rail hanger.
Figure 7A:
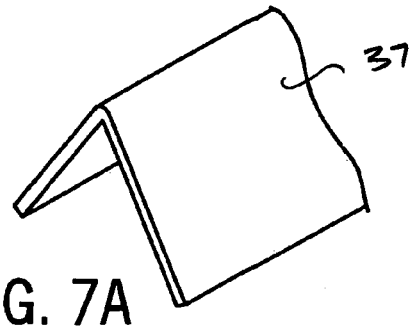
FIGS. 7A-D are partial perspective views of exemplary embodiments of support structures for a non-food warming appliance.
Figure 7B:
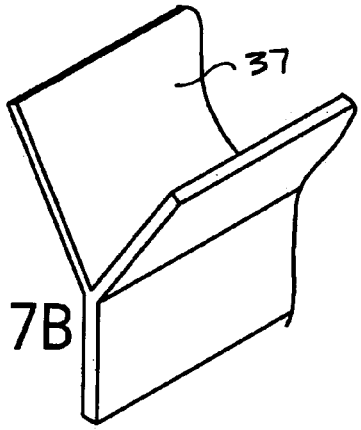
Figure 7C:
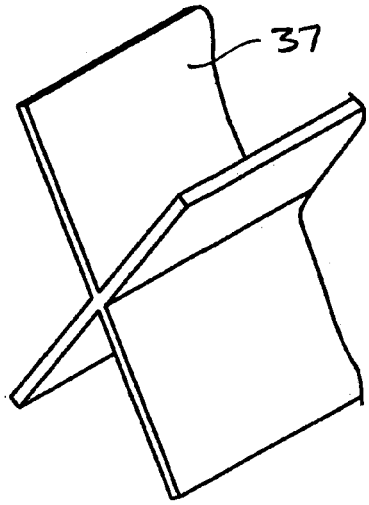
Figure 7D:
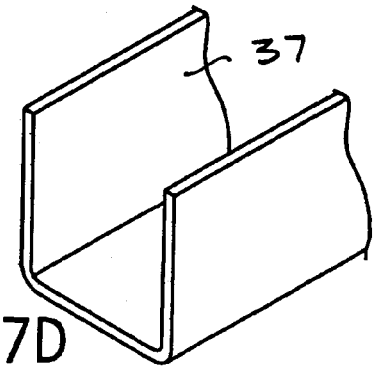

Referring to FIGS. 2, 6 and 7A-7D, non-food objects O, shown by way of example as towels, are arranged (e.g. hung, suspended, draped, etc.) over an object support structure 37, shown for example in FIGS. 6 and 7A as an inverted V-shape member (e.g. bars, rails, etc.) to expose a greater portion of the object's O surface area to the heated air circulating within the chamber and around the object(s) O. According to alternative embodiments, the support structure 37 can be made of a perforated material or mesh, as one way of increasing the open space for the circulating heated air to reach a greater portion of the object. The support structure 37 in cross-section may be similar to an inverted "V," inverted "U," "X," upright "Y" or other suitable cross-sectional configuration intended to "spread open" a "draped" object (shown as a towel) in a manner to allow heated air within the chamber to circulate about and through the draped object O (see FIGS. 7A-7D). It is believed that textiles tend to warm-up faster than metals or plastics, therefore reducing the surface area of a metal support structure is intended to speed up the warming of textile objects O supported by a metal support structure. The support structure 37 can also be composed of rods or a mesh material configured as described above. The words "inverted "V" or "rail" in this application are not intended to be limiting and a support structure having any suitable cross-sectional configuration is intended to be within the scope of this disclosure.

Referring further to FIG. 6, objects O (shown for example as a towel or other object formed from textile, cloth, fabric, etc.) are placed over the support structure 37 which is formed from a sufficiently rigid material to "open up" or spread and hold the object(s) O so that circulating heated air within the chamber can pass into and around the fabric. Each object support structure 37 is preferably attached to supports (such as a cross member—not shown) at both of the support structure's ends. The support or cross member may be attached a access cover assembly 24 so that the support members and objects may be "drawn out" of the chamber by opening the door or cover assembly. Alternatively, movable fixtures such as slides or glides, etc. may be coupled to the supports or cross member and to the chamber 21 so that the support members and objects may be drawn-out of the chamber independently of the front door or cover assembly.

Figure 16:
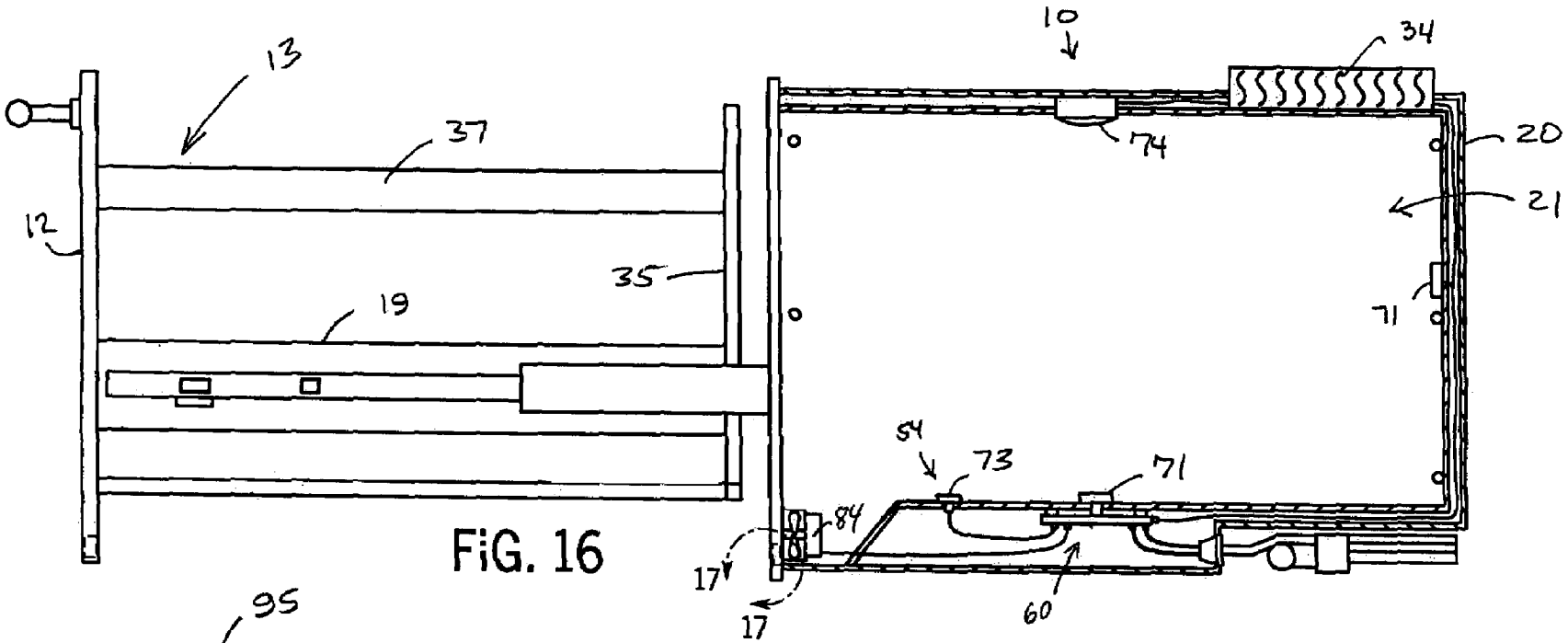
FIG. 16 is a side view of an exemplary embodiment of a non-food warming appliance with the drawer extending from the cabinet and illustrating exemplary placement of several components.
Figure 25:
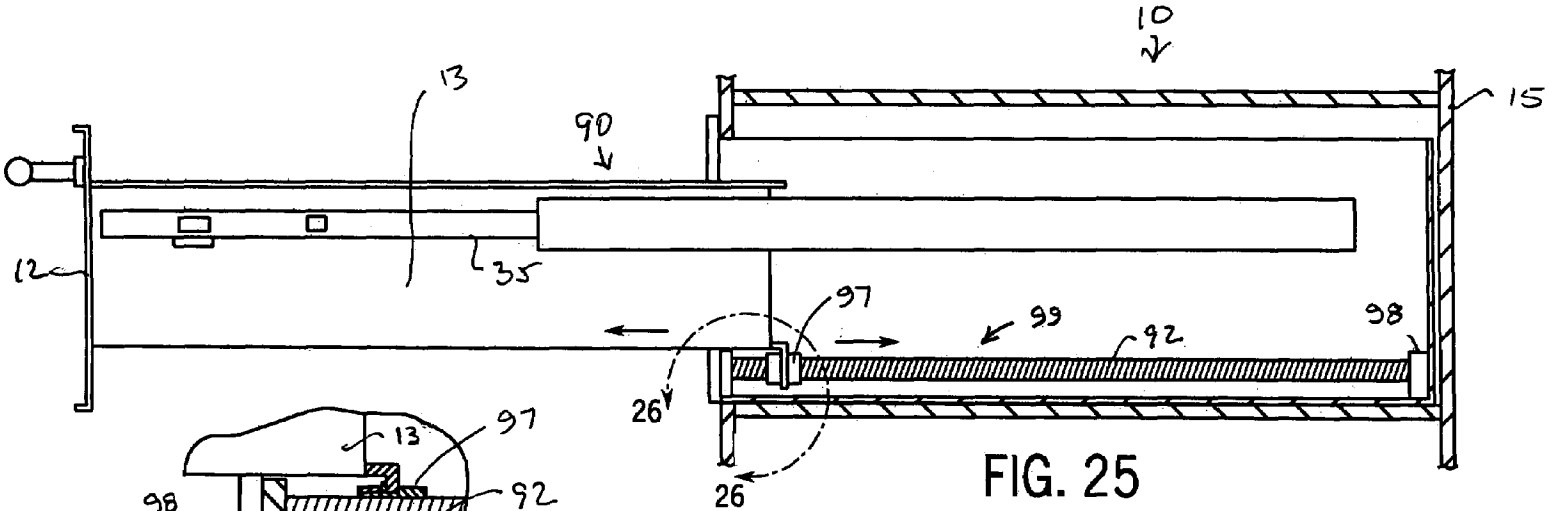
FIG. 25 is a sectional side view of an exemplary embodiment of a non-food warming appliance, including a powered drawer.
Figure 28:
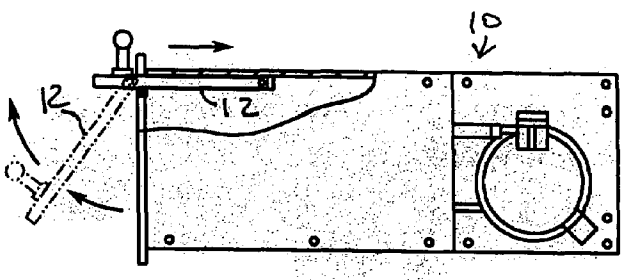
FIGS. 27 and 28 are bottom views of alternative embodiments of a non-food warming appliance illustrating coupling and motion of the door for the appliance.
Figure 27:
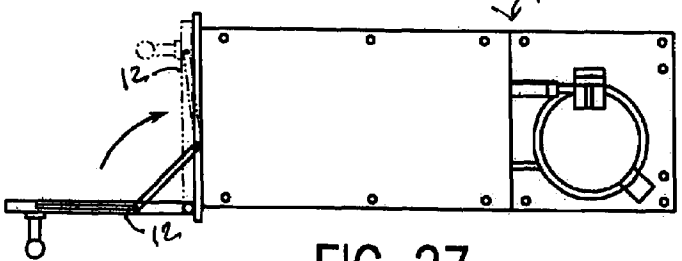

Referring to FIGS. 2 and 20-21, the access cover assembly 24 is shown to comprise an inner panel 25A and outer panel 25B (shown to form a door 12), with an exhaust fan 84 (including a constant or variable speed motor) coupled adjacent to the inner panel 25A. Alternative positions for the exhaust fan 84 can be in the back or on the sides of the chamber 21 (e.g. near the bottom, etc.). With the exhaust fan 84 communicating with the door 12, contact pins (not shown) interfacing between the door and the cabinet 14 (or 15) co-act to complete a circuit when the door is closed, which provides power to the fan 84 and the heating element (s) 34 for heating the chamber 21. Fasteners, such as screws or rivets or the like are used to assemble the components of the cover assembly 24 together, but other methods of assembly can be used (e.g. snap-fit connectors, interference fit, etc.). The door 12 may be fixed directly to the drawer structure and thus movable with the door structure (such as shown in FIGS. 2, 16 and 25), however, the door(s) 12 may be hinged and/or slideably coupled to the cabinet to permit extension of the drawer structure from the cabinet (such as shown for example in FIGS. 27-28).

Figure 18:
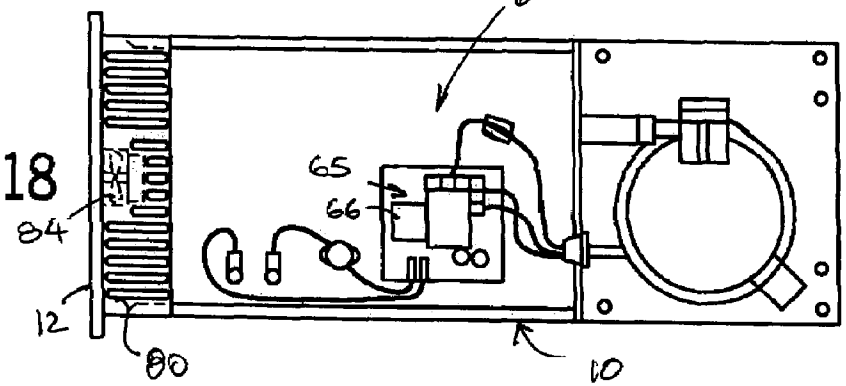
FIG. 18 is a bottom view of the non-food warming appliance illustrated in FIG. 16.
Figure 29:
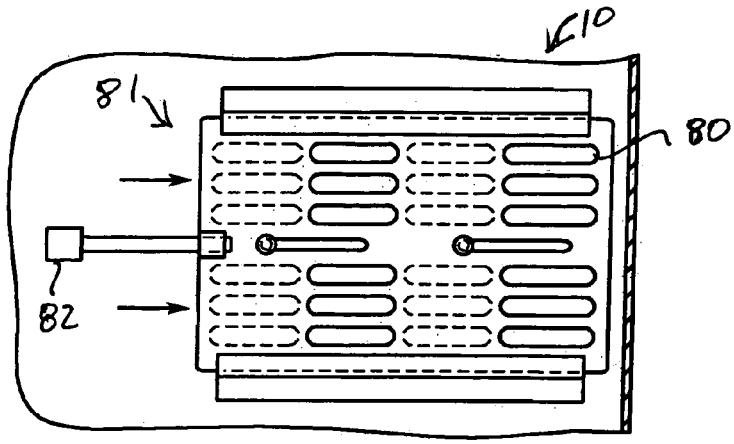
FIG. 29 is a plan view of an exemplary embodiment of a venting apparatus powered with a venting actuator.
Figure 30:
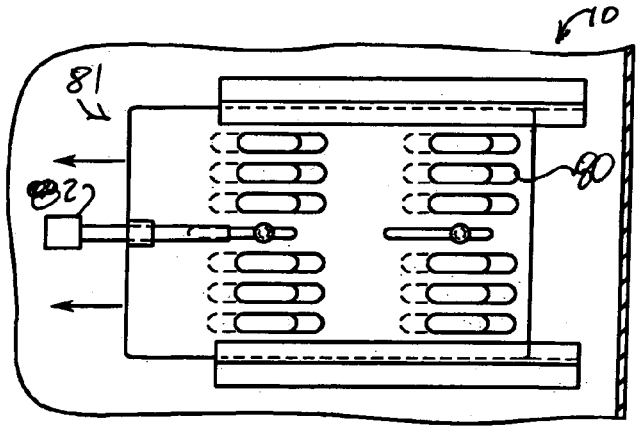
FIG. 30 is a plan view of the venting apparatus illustrated in FIG. 29 illustrating a position different from that illustrated in FIG. 29.
Figure 31:
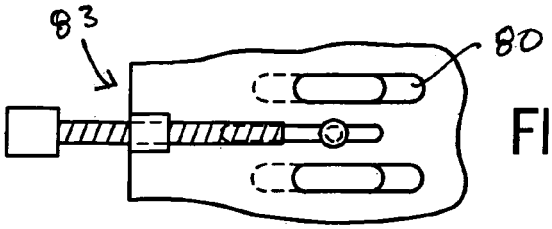
FIG. 31 is a plan view of an exemplary embodiment of a venting actuator of a screw drive type.
Figure 32:
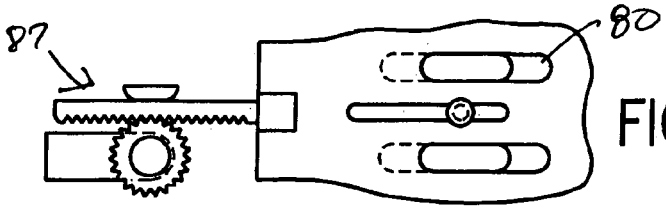
FIG. 32 is a plan view of an exemplary embodiment of a venting actuator of a gear device.
Figure 33:
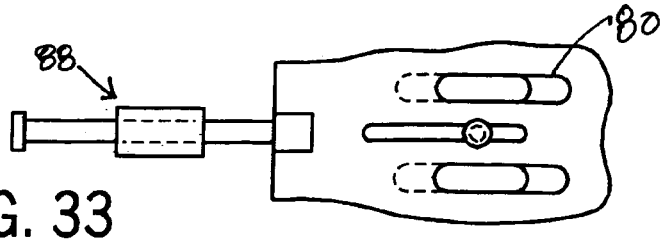
FIG. 33 is a plan view of an exemplary embodiment of a venting actuator of a solenoid drive.

Referring further to FIG. 2, vent opening(s) 80 (e.g. slits, slots, holes, passages, etc.) can also be configured in the cabinet 14 for expelling air out from the chamber 21 (shown for example as located on a top panel of the cabinet above the heating element 34 in FIG. 2, but may be provided at the bottom of the cabinet, such as shown for example in FIG. 18 to provide an alternative air flow pattern). Air can be vented in any direction (e.g. into, or out of, the chamber 21) such as by reversing the direction of operation of fan 84, and volume of air circulated through the chamber may be regulated by the fan speed and the vent apertures 80, which may be fixed in size, or have an adjustable size (e.g. manually adjustable, or mechanized in conjunction with controls, etc.). According to a preferred embodiment, the vent apertures 80 are the entry points (e.g. inlet, intake, etc.) for fresh air. Any suitable number of vent apertures can be provided having a fixed size or an adjustable size. For example, a venting apparatus 81 (as shown for example in FIG. 2) includes a vent actuator 82 configured to adjust the size of the vent apertures 80 through use of a plate (shown as a damper 81) movable by the vent actuator 82 between a closed position (see FIG. 29) to completely close the vent apertures 80 and an open position to completely uncover vent apertures 80, and any intermediate position there between (see FIG. 30) as desired to regulate the flow of air through the chamber. According to any exemplary embodiment, the vent actuator comprises, for example, a screw drive 83 (see FIG. 31), or a gear device 87 (such as a rack and pinion—see FIG. 32), or a solenoid drive 88 (See FIG. 33). According to alternative embodiments other drive mechanisms may be used for the vent actuator such as a bimetallic device, or an electromagnetic device, or other suitable electronically or electro-mechanically controlled device or other suitable equivalents of a driver device for adjusting the position of the damper 81 in relation to the vent apertures 80. The ability to control the flow of air and moisture within the chamber 21 by an actuator 82 coupled to a damper-vent apparatus is intended to regulate the flow of air being exhausted from, or brought in to, the chamber 21 of the warmer drawer 10. The vent actuator 82 is controlled by the electronic control system 60 (to be further described) to permit regulation of the heat, moisture and/or air flow within the chamber 21, based on user selected inputs (or pre-programmed inputs) and signals received from sensors communicating with the chamber.

Referring further to FIG. 2, one embodiment of the non-food warming appliance 10 is configured to vent heated air in the event of air movement failure for minimizing impact to objects within the chamber. With this configuration the heating element(s) 34 are located at the top or topsides and vent apertures 80 are located above the heating elements. In the event of blower or fan 84 failure, blockage, or loss of air movement, the heated air within the chamber rises and vents upward and out through the vent apertures naturally (e.g. similar to a "chimney" flow arrangement, etc.) and is intended to protect heat sensitive objects (such as cloth(s)/towel(s), etc.) inside chamber 21 from heat damage (e.g. discoloring, burning, etc.). Determination of fan failure, or other event that may result in excessive heating may be detected by suitable sensors and the electronic control system may be arranged to move the vent actuator 82 to a full open position (if not already open—such as a "fail safe" position, etc.).

Referring further to FIG. 2, the drawer structure 13 includes the access cover assembly 24, a rear panel 35 and a delivery system that includes support guide members 19, and can be made of any suitable material such as stainless steel, plastic, coated metal or other temperature-resistant materials and can be of a decorative nature to match (or contrast with) the surroundings desired by a particular user. The warmer drawer 10 can be configured with a provision to allow the drawer structure 13 to be pulled partially or completely from of the inner cabinet 15 to enhance a user's ability to install/remove objects O (such as for example cloth(s), or towel(s), etc. on object support members 37) without having to reach inside the chamber 21 or come in contact with any of the sensors or heated surfaces. In order to enhance the functionality and usefulness of the warmer drawer 10, additional accessories may be included for use within the chamber. For example, a pan 36 (e.g. tray, holder, etc.) can be provided for wet objects O and positioned to evaporate the moisture in the object(s) O (such as cloths, towels, robes, etc.—see FIGS. 8-9 for example). Additionally, a wire rack 39 (e.g. drying rack, an accessory rack for footwear or gloves, etc.) can be configured to couple to the pan 36 to further enhance air circulation and drying of the objects. The front cover assembly 22 may be provided with any suitable door configuration, shown for example as hinged front doors 12. According to any exemplary embodiment, the front cover assembly permits the user to open the warmer drawer, pulling out the inside rack 39, drawer structure 13, shelf, or pan 36, and swinging or folding the door(s) 12 out of the way (or pulling a panel type door that is fixed to the drawer structure, such as shown for example in FIGS. 1, 16 and 25). The door(s) 12 can be hinged rather than fixed panels, a feature which provides the benefit of having the door(s) out of the way when accessing the contents within the chamber (see FIGS. 27-28).

Figure 8:
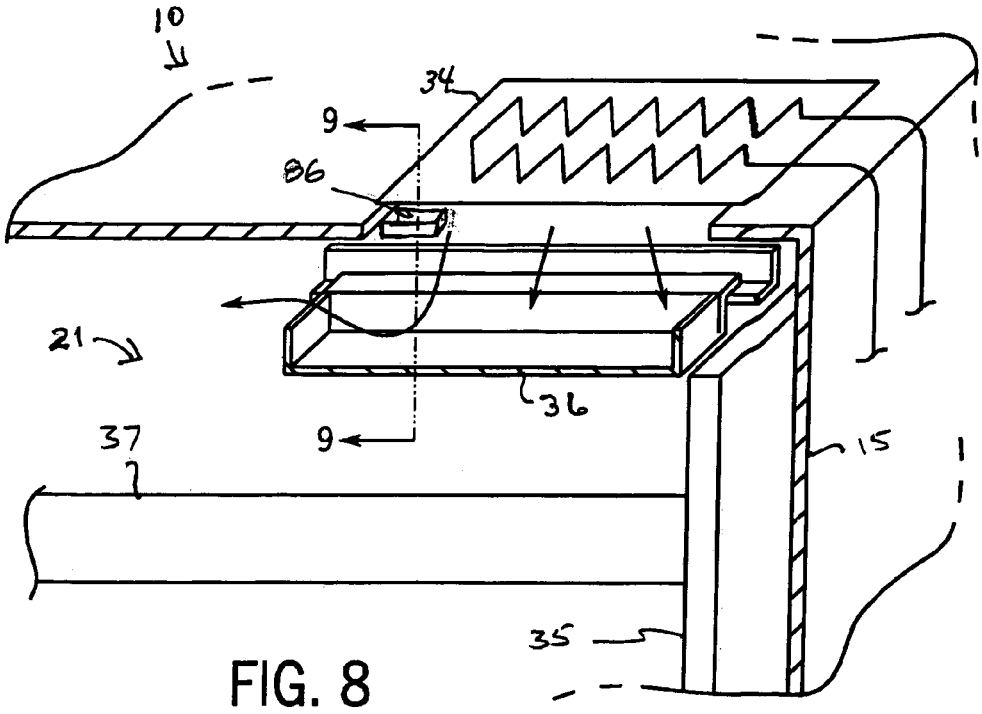
FIG. 8 is a partial side view of an exemplary embodiment of a non-food warmer appliance including a pan configured to hold wet objects.
Figure 9:
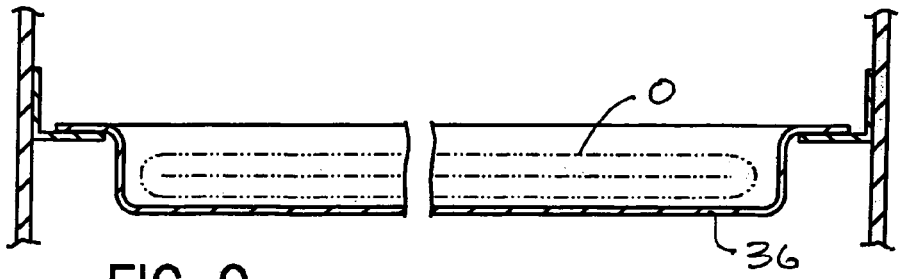
FIG. 9 is a sectional side view of the pan illustrated in FIG. 8 along the line 9-9.
Figure 10:
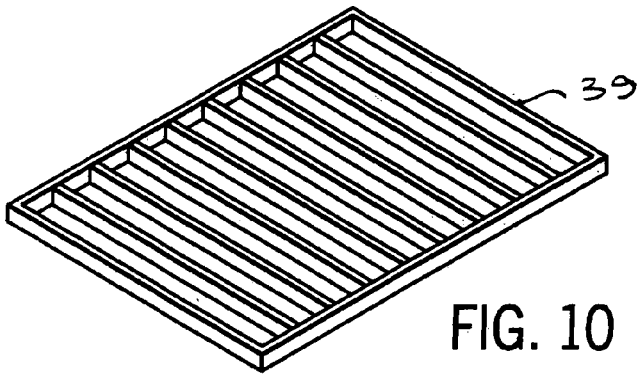
FIG. 10 is a perspective view of an exemplary embodiment of a wire rack configured for use with the pan illustrated in FIG. 8.
Figure 11:
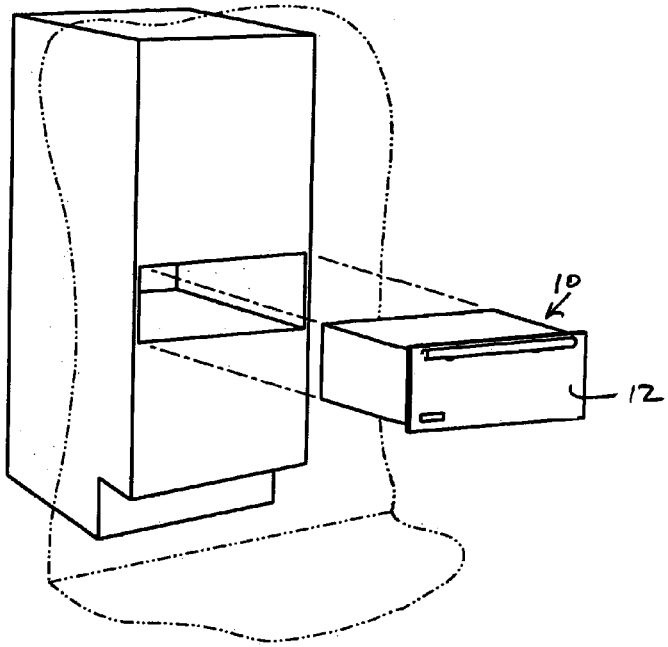
FIG. 11 is a perspective view of an exemplary embodiment of a non-food warming appliance configured for one of a wall and cabinet installation.
Figure 12:
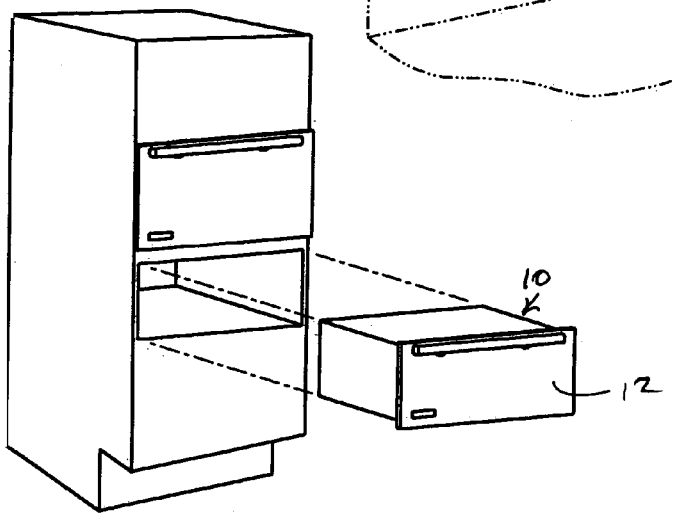
FIG. 12 is a perspective view of an exemplary embodiment of a non-food warming appliance configured for a stacked unit installation.
Figure 13:
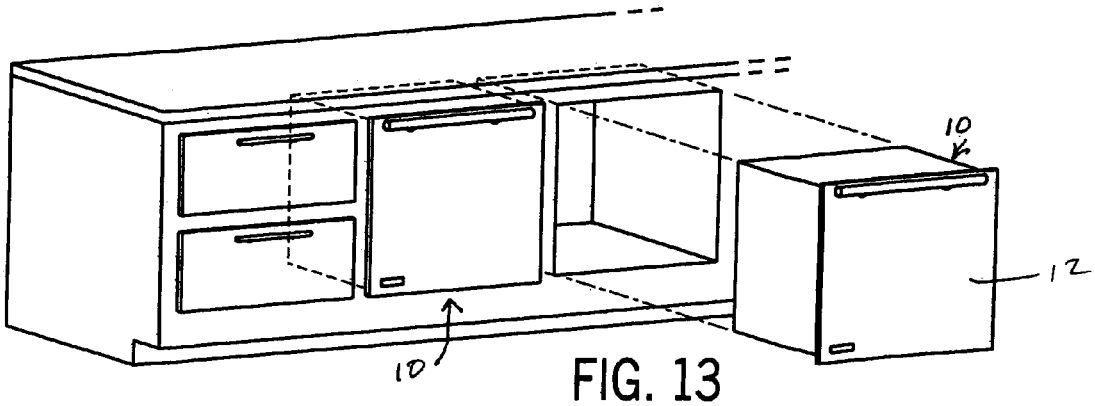
FIG. 13 is a perspective view of an exemplary embodiment of a non-food warming appliance configured for an under-counter installation.

Referring further to FIGS. 2 and 8, a heating apparatus, such as heating element(s) 34 are provided to generate heat and are shown located at the top of the chamber 21 (but may also be provided along the sides or other suitable location communicating with the chamber 21, such as remotely and communicating through a duct, etc.). In the event of a loss of air movement within the chamber (e.g. fan failure, etc.), the heated air rises upward within the chamber and out through vent openings 80, and away from the objects O within the chamber 21. Although the heating element is shown for example as a single cal rod type heating element, it should be understood that other heating elements can replace or be added to the standard, single cal rod style heating element. Such heating elements for replacement or addition are understood to include (among others) convection heaters; axial heaters (e.g. such as those having a heating element without a fan); wire heating elements; heat plates; thermal ceramic heaters; flexible heaters (which are also commonly referred to as thin film heating elements) and can be formed and bent into any desired pattern or shape. Other heating elements intended for application as a heating source in the non-food warmer drawer may include: light sources; inductive heaters; heat pumps (which can provide heating and cooling); warming liquids; sonic heat generators; heat exchangers; microwave, gas and solid fuel products (or any suitable combination thereof). The above-mentioned types of heating elements are generally within at least one of the following categories of heat sources: radiant, infrared, sonic vibration, conduction, inductive, convective, resistance, and microwave. These heating elements can be placed on the top of the cabinet (as shown in FIG. 2) or on the side of the cabinet, or in any other suitable location, including remotely located and in fluid communication with the chamber of the non-food warmer drawer. Use of these heating elements in combination with the electronic control system and appropriate sensors is intended to improve the heat control and accuracy of the temperature inside the chamber and achieve a relatively even temperature distribution or profile throughout the chamber 21. The heating element(s) 34 are shown to receive a supply of power via the power board(s) 66 (see FIGS. 3-4) from an energy source 64 such as an AC or DC source powered in accordance with specifications for a particular warmer drawer. The use of two or more heating elements 34 can be used to improve the uniformity of temperature distribution and minimize thermal gradients within the chamber, and also to reduce start up times (e.g. multiple heating elements may be activated during the startup or warm-up phase and then be selectively de-energized or "cut-back" as the desired temperature is attained, and then perhaps automatically reenergized to maintain the desired temperature, such as when the drawer is opened, or due to loading of cold or cool objects in the clamber, etc.). The use of electronics for elements of the control system 60 and use of different/multiple heating elements at strategic locations can greatly improve warm up times to reach desired temperatures faster. Greater control of temperature within the chamber is intended to minimize the amplitude and duration of any temperature overshoots and undershoots, thus resulting in better temperature control of the objects to be warmed.

Figure 4:
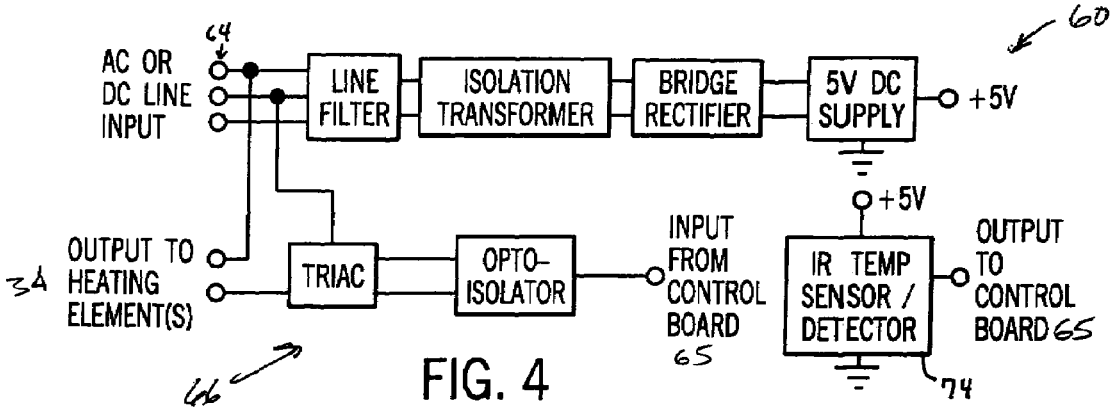
FIG. 4 is a block diagram of an exemplary embodiment of a detector circuit for a non-food warming appliance having an electronic controller and including an infrared temperature sensor.
Figure 5:
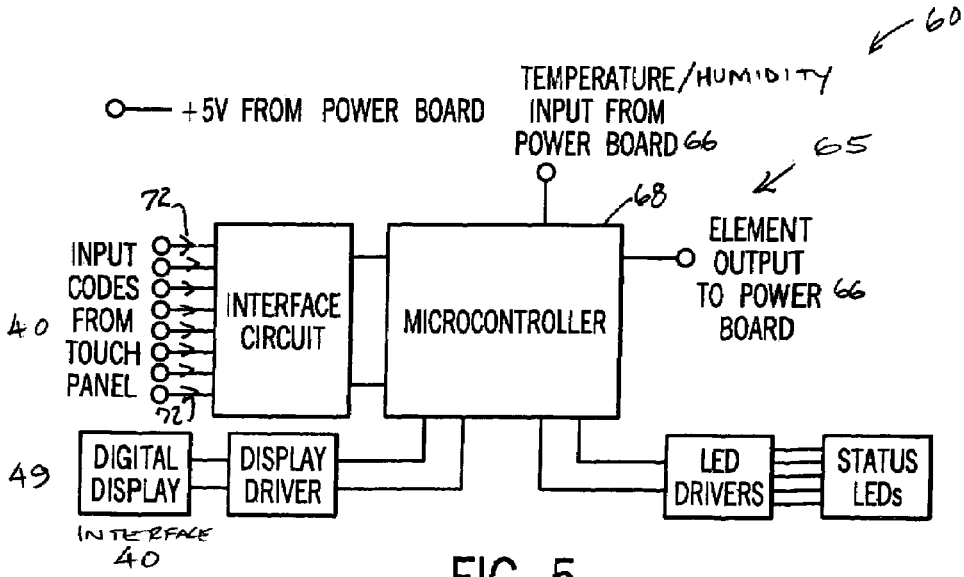
FIG. 5 is a block diagram of an exemplary embodiment of an electronic controller for a non-food warming appliance.

Referring to FIGS. 3-5, an electronic control system 60 for the warmer drawer is shown according to an exemplary embodiment. Electronic control system 60 is shown to include electronic printed circuit boards shown as a power board(s) (shown for example as two power boards 66 in FIGS. 3-4) and a control board(s) (shown for example as a single control board 65 in FIG. 5), which describe one type of electronic control system 66. However, the control board (s) and power board(s) may be combined into a single board. The control board 65 of the electronic control system 60 is shown to receive a power supply from a power board 66 and to include a central processing unit (shown as a microcontroller 68) that is configured to receive inputs from various sensors that provide signals representative of the operation of the warmer drawer (shown for example as a temperature signal input from a temperature limited 54 or temperature sensor 73), and to review inputs 72 from the user interface 40 (via an interface circuit) and to provide outputs to various display devices or indicators shown for example as display device 49 and to status LEDs that may be provided in the user interface, display device, or other suitable location on the warmer drawer for conveying information to the user. The microcontroller 68 is also shown to provide an output to power board 66 for operation and control of the heating elements 34 and the fan/blower 84 and ventilation system actuator 82 for control and regulation of heating, airflow within and ventilation of the chamber 21 and objects O within the chamber 21. The power boards 66 are shown to receive a power supply input from an energy source 66 (such as a line input from a conventional power source, etc.) and to communicate with various sensors (shown as a temperature sensor(s) 73 and a humidity sensor(s) in FIG. 3, and an infrared temperature sensor 74 in FIG. 4) and to provide signals from the sensors to the control board 65, and to receive control signals from control board 65 for control and operation of the components of the warmer drawer 10. According to an alternative embodiment, the control board may also provide suitable output control signals for operation of the drawer structure of the warmer drawer (such as for use in a power-operated drawer structure—shown for example in FIGS. 25-26, to be further described). According to other alternative embodiments, the sensors may include any suitable sensors for conveying operating information to the electronic control system.

The control board 65 of the electronic control system 60 (through the power board(s) 66) is configured to regulate the electric power to the heating elements 34 such that the heat output to the chamber 21 can be held substantially constant. In this regard, the applicants believe that regulating the power and thus controlling the heat is a significant improvement in controlling temperature in non-food warmer drawers. This can be accomplished by an electric thermal-limiting device. For example, microprocessor 68 of control board 65 is shown to be in communication with a positive temperature coefficient of resistance (PTC) current/voltage controller 71 through power board 66 (see FIG. 3). According to an exemplary embodiment, the electronic control system 60 includes a positive temperature coefficient of resistance (PTC) current/voltage controller 71 for controlling the heat and power requirements and providing rapid response during start-up. The PTC controller 71 allows current to the heating element(s) 34 and as temperature gets close to the upper limit, the PTC controller 71 limits the current to the heating element 34, stopping the rapid rate of heat/temperature increase in the chamber 21, thus minimizing overshoot. PTC thermistors (thermally sensitive resistors) are solid state, electronic devices, which detect thermal environmental changes for use in temperature measurement, control and compensation circuitry and exhibit an increase in electrical resistance when subjected to an increase in body temperature. PTC devices remain in their low resistance state at all temperatures below the temperature corresponding to the desired set point. When the temperature corresponding to the desired set point is reached or exceeded, the PTC exhibits a rapid increase in resistance thereby quickly limiting current to the heating element circuitry to minimize temperature overshoot. Once the temperature within the chamber decreases to a normal operating level, the device resets to its low resistance state providing full load current to the heating element. The dramatic rise in resistance of a PTC thermistor at the transition temperature tends to makes it an attractive candidate for current limiting applications. For currents below the limiting current, the power being generated in the unit is not sufficient to heat the PTC to its transition temperatures. However, when abnormally high fault currents flow, the resistance of the PTC increases at such a rapid rate that any increase in power dissipation results in a reduction in current. These devices have a resistance temperature characteristic that exhibits a very small negative temperature coefficient until the device reaches a so-called "critical" temperature for the upper limit or set point of the warmer drawer, which is referred to as the "curie," switch, or transition temperature. As this critical temperature is approached, the PTC device begins to exhibit a rising positive temperature coefficient of resistance as well as a large increase in resistance. This resistance change can be as much as several orders of magnitude within a temperature span of a few degrees. Thus as the chamber temperature increases from an ambient temperature, the PTC device increases in surface temperature reducing the ability to dissipate heat which results in an increase in resistance resulting in reducing the current to the heating element. This increase in resistance and reducing current also slows down the heat up when coming to the set point. The PTC device also does not completely stop the flow of current to the heating element, but rather, limits the current to the heating element. Thus providing and maintaining a steady temperature by substantially eliminating on/off "swings" that are characteristic of other conventional non-food warmer drawers. This design also provides users with cost savings; since the undesirable "on/off cycling" with its corresponding overshoots and undershoots is avoided, the full current draw of the heating element is also avoided and the warming drawer uses only the required current for start-up heating and maintaining the desired temperature. According to other embodiments, the control system includes any one or more of a micro controller(s), micro technology, integrated circuits, drivers and microprocessors that may be mounted on one or more printed circuit boards, to provide the desired functionality of interfacing with the heating elements, the ventilation system, the sensors, the display device and the user interface.

Such embodiment providing an electronic control system 60 as described above is believed to be an improvement over prior art methods of cycling power "on and off" in an attempt to control the heat within the chamber. With the electronic control system, the necessary heat load for the chamber can be determined and then only that amount of power/heat necessary is supplied. This also can prevent or minimize temperature overshoots by quick warm-ups and when "almost reaching" the set point, by limiting the amount of heat energy when reaching the set point. The ability to better regulate the electrical power to the heating elements such that the power output can be regulated will improve accuracy, and similarly increase or decrease the heat output to the chamber with improved accuracy. This innovation is also believed to reduce the user's operating costs in comparison to conventional non-food warmer drawers. The electronic control system through interaction with the sensors and user interface can determine the necessary heat load for the chamber and supply only that amount of power to the heating elements 34 (in combination with control of air circulation by the fan 84, and inlet/exhaust by ventilation actuator 82) necessary to quickly heat the air and objects with chamber 21 to the desired temperature.

Referring to FIG. 19, a user interface 40 is shown according to an exemplary embodiment. User interface 40 is intended to permit convenient operation and control of the non-food warming appliance 10 by a user. User interface 40 is shown to include a display device 49 that provides the ability to display information to the operator such as the temperatures and times through the use of electronics, illumination of indicators such as status LEDs, and the option of using a mechanical device (e.g. knob, switch, etc.) to interact with the electronic control system 60 in order to simplify the user's involvement with the warmer drawer. The ability to accurately control operation of the warmer drawer without a "complex" user interface is intended to enhance the ability to heat an object O to a desired temperature and hold it at that temperature until needed while minimizing the concern for damage to the object (such as discoloration or burning, etc.) that might otherwise be caused by operator error with more complex user interfaces. According to one embodiment, the user interface may be a switch (e.g. toggle, rocker, touch, etc.) such as for example, an "on/off" type switch shown as switch 48 (shown for example on a remote control device in FIG. 19, and on the user interface 40 in FIG. 22, but may be located on the cabinet of the warmer drawer or any other suitable location).

However, through the use of suitable electronics in the electronic control system, complete user programmability is available if desired and selected during the design of the warmer drawer. For example, a user interface 40 for a warming drawer 10 (see FIG. 22), may be integrated with a display device 49. The user interface 40 is shown as an electronic touch control panel 43 (e.g. touch pad, key pad, input device, etc.) according to an exemplary embodiment. The user interface 40 may include any suitable input elements 45 (shown by way of example in FIG. 22 as FAN ON, FAN OFF, FAN SPEED, TEMPERATURE UP, TEMPERATURE DOWN, TIMER ON, TIMER OFF. LIGHTS ON, LIGHTS OFF, LIGHTS LEVEL, and four selectable settings marked 1, 2, 3 and 4 (such as pre-programmed settings), for selection and input of desired operations by a user to an interface circuit on the control board 65 of the electronic control system 60 for interaction with microcontroller 68, however any suitable input elements may be used to suit a particular application. According to any exemplary embodiment, the user interface 40 may be provided using any suitable technology such as (but not limited to) a piezo touch panel, or a capacitance electronic touch control panel (e.g. made of glass, metal or plastic, etc.) with selection of the operating function(s) made by touching the surface of the glass, metal, or plastic to operate any size warmer drawer could be used. In addition, tactile (membrane switches) touch control panel switch pad(s) for touch controlling the operations of a warmer drawer could be used. For any size warming drawer, other types of user interfaces may include resistance type touch control keypad, whereby touching plastic, metal, glass, etc. at a location causes a change in an electrical signal to be measured and the electronic control system responds to this change. According to any exemplary embodiment, the user interface may include use of membrane switches, piezo, capacitance, paddles touch soft switch technology, paddles touch digital encoder (micro-encoder), capacitive, infrared, high frequency, magnetic, field effect, charge transfer, hall technology resistance and inductive. Further, the face panel of the user interface can be fitted with decorative overlays, underlays, labels, trim and completed control panel assemblies. Touch control keypads or panels can be installed flush, raised, or recessed for use in connection with the electronic control system. Further, the touch control key pads of the user interface 40 can be installed in any plane of the warmer drawer 10 (or remote structure when operated by remote control) with the use of electronics. According to an alternative embodiment, the display device and the user interface may be arranged as separate (yet still intercommunicating) devices at any suitable location on the warmer drawer.

The components of the user interface 40 may be placed on any surface to accommodate any design or for matching or simulating the look of other products that may be associated with the warmer drawer. The touch control keypads of the user interface 40 and display device 49 can be placed on the front of a warmer drawer 10 to provide the user with "instant viewing" of the operations and functions without having to open up the warmer drawer (such as shown for example in FIG. 22). Touch control panels can be made of metal, plastic or glass to suit a particular application. The use of a micro controller or integrated circuits and drivers, PC board(s), processor(s), and power, and other electronics (shown for example as a microcontroller 68 in FIG. 5) can be used in the electronic control system 60 to interface with input codes 72 from the touch pads of the user interface 40 to control operation of the components of the warmer drawer 10. Any size from a small to a large warmer drawer can be fitted for use with a touch type control pad (e.g. piezo, capacitance, resistance, etc.). Further, any size from a small to a large warmer drawer can be fitted for use with an induction touch control pad. The design of the electronics can be unique or matched to the other looks, aesthetics, appearance or décor on adjacent or cooperating appliances or structures. The overall size, design, look and feel of a warmer drawer can be matched to the size, design, look and feel of any appliance or structure.

According to another exemplary embodiment, the touch control panels of the user interface 40 can be remotely controlled in a location away from the warmer drawer (see FIG. 19). Remote control can be by wire or by wireless controlling the functions of a warmer drawer. The touch control panels of the user interface 40 may have graphics (e.g. pictographs that are unique or specific to the design for the matching product(s) or specific to the required designs and functions, etc.).

According to another exemplary embodiment, the display device 49 and/or user interface 40 may be placed on any desired surface of the warmer drawer or associated structure (e.g. to accommodate any design for matching or simulating the look of other products the appliance may be paired with, or to protect the components from damage, or exposure to adverse environments, etc.). By way of example, the display device 49 and user interface 40 may be integrated and arranged to be "hidden" from normal view by the closing of a sliding panel (which may be spring-biased) or by integrating the display and user interface with a rotating panel or L-shaped plate (shown for example as a rotating drum 41 in FIGS. 23A-24B) which may be mounted on a stationary portion of the warmer drawer or on the drawer portion 13 and repositionable in a variety of orientations for ease of viewing/operation and for concealment. This ability to conceal the display/interface, to protect it from damage, or match other appearances, and having it independent of the moving drawer but still have a "flush looking" front surface, or to provide a smooth looking front is intended to enhance the functionality and options available to a user for operation of the warmer drawer. Once the user has completed viewing the display or operating the interface, the user (or the electronic control system of its own accord) can rotate the drum to a position to conceal the display/interface and expose a "matching" panel to provide a smooth-looking or substantially uniform front appearance. According to one embodiment, electronic sensors may be provided in the display/interface so that the user can touch the front of the display/interface for movement to a storage position or for movement to a viewing/operating position. When the electronic sensors in the display/interface sense the "touch", the rotation begins until reaching the stop point (e.g. at the next "position" of the display/interface), such as the display/interface panel provides the smooth front. Another way the display/interface may be moved to the storage position is if the warmer drawer (or another associated appliance) have been "off" for a predetermined time period. Once such a predetermined time period has elapsed, the display/interface may automatically move from the viewing/operating position to the storage position. A drive device such as a motor or actuator (shown for example as a drive motor 42 in connection with the user interface 40 in FIG. 22; however, other suitable devices for rotating the display assembly can be used to provide movement) is provided for operation of the repositionable display/interface. Suitable devices such as switches, stepper motor(s), magnetism, or a positive stop like metal can be used for the location of "stop points" for locating the desired positions of the display/interface. Power and control for operation of the drive motor 42 may be provided by the micro-controlled via the power board(s).

The ability to display in a user interface 40 to the operator the operations, functions, temperatures and times using electronics and to accurately control these operations is intended to enhance the ability to hold desired temperature within the chamber 21. The user interface 40 may include any suitable device for interacting with a user, such as knobs or other suitable devices for initiating input codes 72 to interface with the electronic control system 60. For example, such devices may include loop resistant circuitry which is designed for use in membrane switches; special edge seal finishing for design of key pads using membrane switches; ESD/EMI/RFI shielding; LED, LCD, plasma, dot matrix, and vacuum fluorescent types displays can be used. In addition, electronic touch control panels could use a piezo touch panel (keypad) for selection of operations by the user. Also, a capacitance electronic touch control panel (keypad) could be user and made of glass, metal or plastic, to facilitate selection of the operating functions by "touching" the surface of the glass, metal, or plastic. Another choice could be tactile (membrane switches) touch control panel switch pads. For any size warmer drawer 10, a user interface 40 in the form of a resistance type touch control keypad could be used whereby touching plastic, metal, or glass at a desired location causes a change in an electrical signal (such as input signals 72 shown in FIG. 5), is measured, and the electronic control system responds to this change. Use of membrane switches, piezo, pad-less touch soft switch technology, pad-less touch digital encoder (sometimes referred to as a "micro encoder"), capacitive, infrared, high frequency, magnetic, field effect, charge transfer, hall technology, capacitance, resistance and inductive devices for the user interface can be fitted with decorative overlays, under lays, labels, trim and completed control panel assemblies. Remote control of warmer drawer 10 functions can be by wire or wireless user interface 40 devices. Keypads can have graphics specific to the design for matching other mating products or can be specific to the required designs and functions of the warmer drawer. The use of an electronic control system provides the user with better control and offers more flexible operations than can typically be obtained with a mechanical control.

Another embodiment of a non-food warmer drawer 10 provides a factory preset function to be controlled by the electronic control system or by suitable mechanical controls in communication with an AC or DC electronic temperature and/or humidity sensor(s) (such as sensors 73, 74 and/or 77) located for contact or access to a wall or inside region the chamber 21. The output from the AC or DC electronic temperature sensors is provided to the control board 65 (i.e. at "temperature/humidity input from power board 66"). A non-food warmer drawer designed to be controlled by the electronic control system and equipped with an electronic temperature sensor located inside the non-food warming drawer or in the chamber such that the temperature inside or next to the non-food warmer drawer can be detected accurately and proper output control signals provided to regulate the heat provided by heating elements 34, the operation and speed of fan/blower 84 and the position of ventilation system actuator 82.

Temperature detection through sensors can be accomplished by a wide variety of technologies such as resistance temperature detectors (RTD), thermistors, IC sensors, radiation sensors thermometers, bimetallic, IR and thermocouples. One widely used device for measuring temperature is the RTD, which provides a low cost option for use with an electronic control system. Even though RTD sensors tend to be relatively slower in response than thermocouples, RTDs offer several advantages over "older style" sensors. For example, RTDs tend to be inherently stable and have greater thermal shock capability, which is advantageous when transporting the warmer drawer to the user. Another advantage is that no special compensating lead wire or cold junction compensation is usually needed. After sensing a signal from the RTD, a conditioning device such as a transmitter is provided to convert the signal from the RTD/sensor to an electrical signal recognizable by the control board. The temperature transmitter may be of a type such as a four wire, three wire or a two wire type, but other types can be used. The optimum form of connection of RTDs is the four wire circuit, since it removes the error caused by mismatched resistance of lead wires. According to an exemplary embodiment, any/all of the above components may be provided on a chip or circuit board to be placed in a desired location for detection of temperature within the chamber and to provide data/information to the control board for controlling the function of the components of the warmer drawer.

According to an alternative embodiment, distributed temperature sensor(s) (which offer the next generation fiber optic distributed temperature sensor that sense temperature at a plurality of points along a stainless steel sheathed fiber and feature a typical resolution of about 0.5° C. and a spatial resolution of about 1.5 m) can be used. The fiber can range up to 2,000 m and can be coiled at specific points of interest. Fiber can be sheathed with a nonconductive polymer for intrinsic applications. Thus, the distributed temperature sensor provides the ability to profile the chamber of a non-food warmer drawer for detection of temperatures throughout the chamber at a great number of discrete locations. Response times also tend to be shorter and this permits the control board to process a more complete target zone (such as an entire chamber space) rather than the one zone within the space. Use of the distributed temperature sensor is also intended to permit the manufacturer to customize the zones within the chamber by placing more temperature sensing points in desired areas for detection.

According to one embodiment of a simplified control scheme, the temperature of the chamber 21 or temperature of objects O placed into the chamber 21 can be detected accurately through the temperature sensor(s) and only an "on/off" type switch (such as a switch 48 shown for example as located on a remote control device in FIG. 19) may be provided for (or with) the user interface. Any suitable temperature sensor, such as an electronic, electromechanical, or mechanical type of temperature sensor can be used for a temperature sensor 73 for detecting temperature, resistance, or power for the control of the temperature of a chamber 21 in the non-food warmer drawer 10. A non-food warmer drawer 10 having factory presets can be controlled by a temperature control device 54 such as a fixed temperature thermostat, thermal-disk, thermal protector, thermal cutoff, or electronics, electromechanical, or mechanical temperature controller/sensor. A non-food warming drawer 10 can also have the ability to detect objects O placed inside the chamber and then set temperature(s) for maintaining a desired temperature of the object.

For example, a non-food warmer drawer with object detection on a target surface may include an infrared temperature sensor (shown as an IR sensor 74 in FIGS. 4 and 16) that collects a small amount of energy (usually about 0.0001 watt) radiated from the target object, and generates an electrical signal that is amplified by a precision amplifier and converted into voltage output. Sensor 74 is intended to be capable of detecting the presence of an object and the temperature of the object and provide an appropriate output signal. The signal is digitized an analog-to-digital converter on the control board (not shown), and an arithmetic unit (not shown) on the control board solves a temperature equation based on Planck's Radiation Law, and compensates for the ambient temperature and emissivity resulting in a temperature reading within a fraction of a second after a user places the object in the field of the IR sensor (i.e. within the chamber 21). Using this technology one can measure the temperature of an object within the chamber or cover the complete surface of the chamber from a 5 meter distance as long as a "field of view" of the sensor is filled by the target. Also, many IR sensors 74 measure in the 8 um to 15 um wavelength band where the atmosphere is almost totally transparent. Such IR sensors 74 can operate in complete darkness and can usually penetrate PE film (for example: a plastic trash bag or saran wrap). The IR thermometer sensor 74 can also be used to detect the presence or absence of an object in the chamber. IR sensing can measure objects that move, rotate, or vibrate (e.g., web process or any moving process). Such IR sensors typically do not damage or contaminate the surface of the object, and measure (e.g. detect, sense, etc.) the temperature of the object and not other parts or surfaces of the chamber of the non-food warmer drawer. An IR detector can also be used for detection of excessive heating (such as fire or other undesirable condition) in the chamber 21 of the non-food warmer drawer 10. The use of thermal sensing technology such as RTDs (resistance temperature detectors), integrated circuit sensors (IC), thermistors, IR thermometers, bimetallic, and thermocouples can also be used. Alternatively, other sensors like photoelectric, photon, optics, indium-gallium-arsenide, and thermal detector could be used in place of IR for the detection of objects within the chamber.

According to any exemplary embodiment, the type of sensor or detector used to monitor temperature of the objects and/or chamber may comprise electronic and/or mechanical technologies. Factory selected settings of the electronic, electromechanical, or mechanical controls for the warmer drawer may be provided to maintain the desired temperature (s) within the chamber as sensed by the temperature-sensing device(s) 73 within a predetermined desired range of operating temperatures or set points. The sensor 73 can be mounted on an electronic board or it can be attached to any wall or location within the chamber where detection of the temperature can be made (see for example FIG. 16). The ability to better detect the temperature within the chamber helps to improve the response time to temperature changes within the chamber, so that the temperature may be more accurately controlled and reduce the effects of temperature overshoot and undershoot by providing a more steady temperature stream. Any electronic, mechanical or electromechanical sensor 73 can be used for detecting temperature, resistance, or power for detection and control of the cavity temperature in cooperation with the electronic control system. Such temperature sensors 73, which can be used are, but not limited to: temperature sensors, thermostats, thermal, temperature controls, thermal protectors, thermal cutoffs, thermal switch, thermal couples, adjustable thermostats, PC Boards thermostats, hermetically sealed, time delay relay, bulb and capillary, cold controls, electronic controls, bimetallic, pressure switches, creep action thermostats, controllers, manual reset, automatic reset, disc thermostat, snap action switch, RTDs (resistance temperature detectors), NTC thermistors (negative temperature coefficient of resistance), PPTC thermistors (power positive temperature coefficient of resistance) may be provided and configured for interfacing with the electronic control system.

According to another embodiment, the user interface device 40 used to activate and operate the non-food warmer drawer 10 can be remotely located, i.e., not on the warmer drawer 10. Remote control or portions of the control can communicate by wire or wireless to operate the warmer drawer 10. A remote control unit 75 can be used as a hand-held unit and can also be placed in a receptacle proximate the non-food warming appliance 10 (see FIG. 19). The remote control unit 75 is configured to communicate with a receiver 79 located at any suitable location on the warmer drawer (and shown on a door 12 by way of example in FIG. 19) and intended to communicate user input selections 72 to the microcontroller 68 of the control system 60 for control and operation of the warmer drawer 10. According to an alternative embodiment, a remote sensing and receiving system may be provided including a sensor(s) and/or a remote receiver along with a remote panel at a different location. The sensor(s) would include a transducer disposed to sense the desired physical parameter in the non-food warmer drawer. The transducer will generate an electrical signal representative of the physical parameters and apply the data to a processor. In response, the processor drives a digital display, which produces visual indications of these parameters. The processor also provides communication between the sensor(s) and the remote receiver to control operation of the non-food warmer drawer. The receiving unit controls the non-food warmer drawer through signals for (among others) turning the unit on, to adjusting the speed of the blowers/fan and temperature as well as on/off times. The sensor(s) and receiver(s) could both have a transmitter and/or receiver to enable communication through signals. A remote sensing and receiving system (or detecting and display system) may also be configured as a remote keypad apparatus that can include a display and a remote transducer unit having a temperature sensor unit or other transducer exposed to the non-food warmer drawer. The temperature sensor unit can be mounted in or near the non-food warmer drawer such that proper detection can be made. However, those skilled in the art will appreciate that the temperature sensor unit may assume any suitable location, which allows it to sense the temperature in the non-food warmer drawer. The temperature sensor could also be configured to convert temperature readings into an electrical signal representative of the heating zone for transmission to the remote display/control unit. In response to a sensed temperature, the data is displayed and transmission of operation requirements is sent to the non-food warmer drawer for processing and operation of non-food warmer drawer functions.

Referring further to FIG. 2, another embodiment of a non-food warmer drawer 10 provides an air circulation system including a blower or fan 84 (shown for example without an integral heating element attached to the fan). The fan 84 is shown secured to the inside of the chamber 21 (but alternatively may be remotely located and in fluid communication with the chamber through a passageway such as a duct), to circulate heated air and/or draw air in/out of the chamber, thereby providing better heat control and improved response time. Circulating and exchanging air within the cavity is intended to reduce "hot spots" within the chamber. Air movement within the chamber 21 occurs as air is exhausted or vented from the chamber. Venting of air from the chamber 80 is intended to help control humidity levels within the cavity. Fan 84 may be provided with a variable speed motor to provide varying air flow rates as needed to control moisture or humidity levels by introducing fresh (e.g. ambient) air into the chamber. In addition, circulating the air within the cavity is intended to provide a more uniform temperature distribution and minimal temperature gradient throughout the chamber. The resulting air movement from a constant speed or variable speed fan can help hold a more uniform temperature throughout the chamber. Temperature sensors 73 and humidity sensors 77 placed in the chamber can facilitate control of the fan 84 and venting 80 in the chamber. Humidity and temperature sensors located in the chamber are configured to provide signals to the electronic control system 60 which provides a signal to control operation of the fan 84 (e.g. on/off and/or speed control, etc.), position of the ventilation actuator 82 (e.g. for regulating moisture/humidity and/or heat within the chamber), and control of power to the heating elements 34.

The humidity sensor(s) 77 may be any suitable type of humidity sensor for interfacing with the electronic control system and providing a signal representative of relative humidity within the chamber. For example, the humidity sensors may be HIH Series humidity sensors such as those commercially available by Honeywell. Another type of humidity sensor is a thermoset polymer-based capacitive sensor. Another type is a thermoset polymer-based capacitive relative humidity (RH) sensor which directly detects change in "relative saturation" as a change in sensor capacitance with fast response, high linearity, low hysteresis and long term stability. Relative saturation is generally the same as ambient relative humidity when the sensor is at ambient temperature. Because this is usually the case, sensor capacitance change is then a measure of RH change. Capacitive RH sensors dominate both atmospheric and process measurements and are capable of operating with a desired accuracy down to about 0% RH. Because of their low temperature effect, they are often used over side temperature ranges without active temperature compensation. Thermoset polymer-based capacitive sensors, as opposed to thermoplastic-based capacitive sensors, allow higher operating temperatures and provide better resistivity against chemical liquids and vapors such as oils, common cleaning agents, ammonia vapor, etc. in concentrations commonly used to clean appliances such as warmer drawers. In addition, thermoset polymer RH sensors usually provide the longest operating life. Relative humidity/temperature and relative humidity sensors can be configured with integrated circuitry to provide on-chip signal conditioning. These sensors contain a capacitive sensing die set in thermoset polymers that interact with platinum electrodes. Other operating sensors useful in the warmer drawer are resistive and thermal conductivity humidity sensors.

Figure 14:
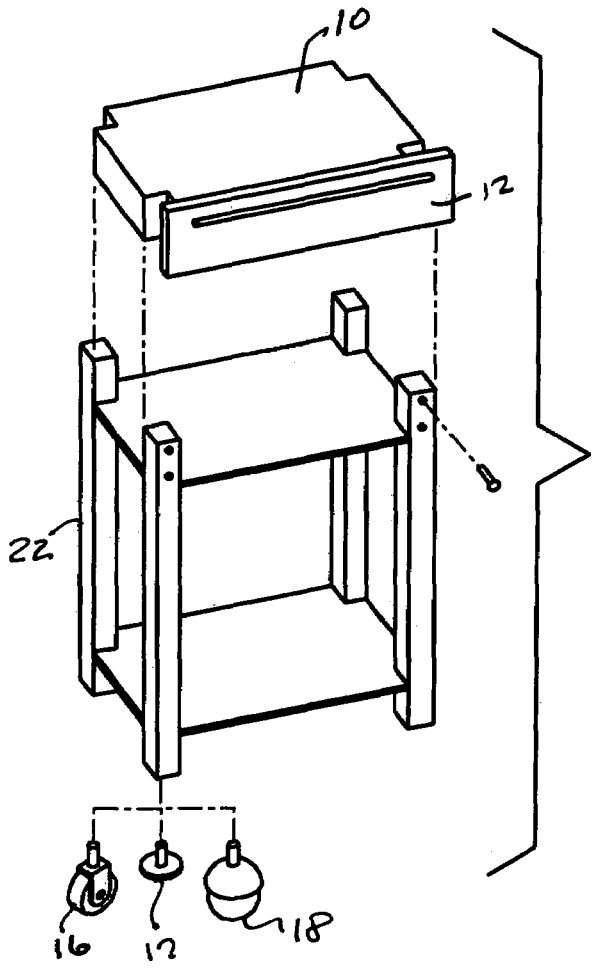
FIG. 14 is a perspective view of an exemplary non-food warming appliance configured to couple to a stand structure which can be movable, as facilitated by several devices.
Figure 15:
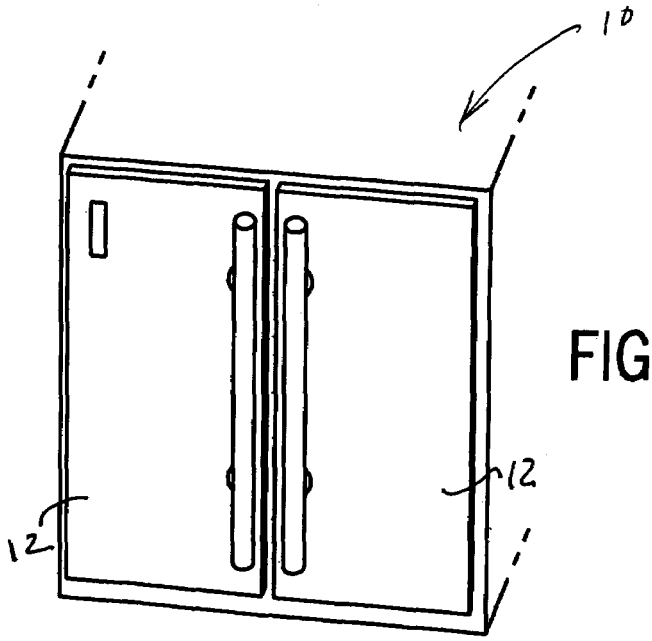
FIG. 15 is a perspective view of the front door of an exemplary embodiment of a non-food warming appliance.

Another embodiment of a non-food warmer drawer 10 provides a mobile pedestal type warmer drawer with drawers, slides, or doors for heating non-food objects O. The warmer drawer is shown for example as combined with a mobile pedestal 22 (see FIG. 14) to provide a non-food warmer drawer that is shown as not built into a wall, cabinetry, structural member, immovable island or other non-mobile structure. The warmer drawer or its pedestal 22 is intended to be self-supporting and rests upon its own structure (shown for example as footpads 17, foot pegs, wheels 16, casters 18 or the like, etc.). The pedestal 22 can be removed when not in use or it can be permanently attached to the warmer drawer. The warmer drawer 10 can be removed and placed on any desired surface for use and then returned to the pedestal 22, or the warmer drawer may remain coupled to its pedestal 22 and immobilized during use (e.g. by wheel locks, chocks, etc.). The mobile frame of the pedestal 22 may be made of wood, metal, plastic, composite material or any combination of such materials intended to provide a lightweight yet sturdy support and transport structure. Another embodiment of the warmer drawer can provide for use indoors or outdoors, such as by weather-resistant features (e.g. sealed touch pads, sealed electronic modules, gasketed door panels, location of vent apertures on an underside of the cabinet, etc.). A mobile non-food warmer drawer can also be installed into a mobile island or cart to be used for warming non-food objects O. According to any exemplary embodiment, the warmer drawer as shown and described (e.g. mobile or stationary, etc.) may be used in any desirable location for any suitable application. For example, the warmer drawer may be used in kitchens (institutional, commercial or residential) for warming non-food items, or may be used in other applications such as hotels, resorts, spas, golf courses, cruise ships where it is desirable to maintain the temperature of non-food objects for the comfort or convenience of users, customers, consumers, guests, staff, etc.

Another embodiment of a non-food warmer drawer 10 provides a factory preset control scheme with pre-programmed temperature set point(s), pre-programmed set time (s), and/or pre-programmed set operation(s) as well as preset of time(s) both on and off for users, as part of the electronic control system 60. Timed off control can be provided if a user desires the unit to automatically control the off time of the warmer drawer (such as for automatic shutoff after a predetermined time period, such as, for example, 4 hours), which can be preset by the factory to suit a user's particular application. The advantage of using factory presets is to provide a warmer drawer 10 that is capable of controlling these items rather than a user, and helps to minimize "user error" or other mistakes in establishing the proper settings. Factory presets can include one, two or more functions, operations, set point(s) with essentially limitless programming entered into electronic control system 60 for control of these items without user involvement (e.g. other than turning the warmer drawer "on" or "off" and/or selecting one or more preset options). The microcontroller 68 of the electronic control system may be preprogrammed with the desired temperature set point(s), set time(s), and operation (s), function(s), etc. to simplify operation of the warmer drawer for a user's intended application(s). For example, timed on/off control can provide the ability to control the on/off time of the warmer drawer, and on/off time(s) can be almost infinitely set with the use of electronic control system. This pre-programmability provides the advantage of being able to enter different functions or operations (e.g. more than one) into the electronic control system and have the warmer drawer control all the desired functions.

Another embodiment is configured to use scent-imparting substances (e.g. perfumes, air fresheners and other additives, etc.) that provide desirable fragrances or aromas to the objects O within the chamber. A depository 86 (see FIG. 8) in gaseous communication with the chamber 21 is shown schematically to receive such scent-imparting substances. The depository 86 may be a pan in contact or proximity with the heating element 34 or configured for evaporative dispersion of the scent at any desirable location for imparting a scent to the objects. Adding desirable fragrances can also be accomplished by venting or ducting from a different chamber or ducting from outside the cavity or by placing the scent inside the chamber at any desirable location.

Another embodiment of a non-food warming drawer is configured with thermoceramic technology functioning as the support structure and heating apparatus in place of the inverted V or cal-rod type heating element(s). With thermoceramic technology, the non-food objects to be warmed are placed over a thermoceramic coated heating plate or thermoceramic coated rail to heat objects O (such as towels and the like) from the "inside-out." Thermoceramic heating elements are generally self-controlling (e.g. by design with a predetermined watt density according to a desired temperature) and are thus particularly suited for use in a non-food warmer drawer to further minimize the potential for overheating of the objects. The non-food warmer drawer with thermoceramic heating elements may be used with (or without) a fan for exhausting heat and/or moisture from the chamber.

Figure 17:
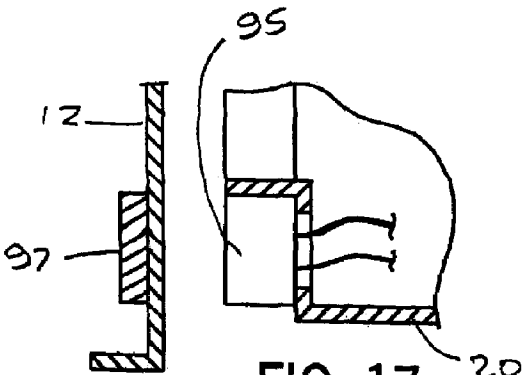
FIG. 17 is a detailed view of sensor arrangement for a powered drawer structure in a non-food warming appliance according to an exemplary embodiment.
Figure 26:
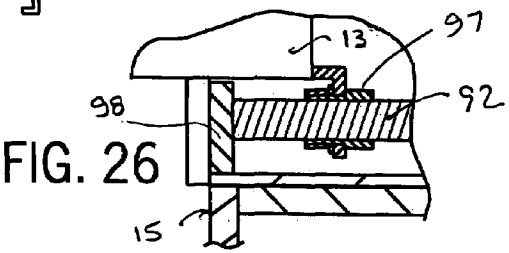
FIG. 26 is a detailed view of an exemplary embodiment of the powered drawer illustrated in FIG. 25.

Referring to FIGS. 25-26, a non-food warmer drawer 10 is shown according to an exemplary embodiment having a powered extendable drawer structure 13 (e.g. "servant drawer"—for convenient access for loading or removal of objects from the chamber) having the ability to open or close by the touch of a user or by some signal device so that a user can open or close the warmer drawer without having to pull or push on a handle or the like through the travel range of the drawer structure. Activation of the warmer drawer can be by touching the front door, breaking a beam, interrupting a signal, or having a feed back signal to a sensor/detect with no (or minimal) hand held control or contact with the warmer drawer or drawer structure. An activation system is provided to control operation of the drawer structure by interfacing with suitable sensors, the electronic control system 60 and a drive system 99. The drive system is shown for example to include a motor-driven drive screw 92 rotatably coupled to the cabinet 15 (such as by a bushing or the like—shown for example as a bearing 98) and interfacing with a threaded sleeve (shown as collar 97) coupled to the drawer structure 13 for extending and retracting the drawer structure 13 from the cabinet 15. Extendable support members (shown as telescoping glides, or guides 19) are provided to guide movement of the drawer structure along its path of travel and to support the weight of objects in the drawer structure. According to one embodiment, an activation system is shown as a hall sensor 95 and a magnet 97 (shown schematically in FIG. 17) used to determine the "stop points" and/or "start points" for movement of the drawer structure and to initiate signals for opening and/or closing the drawer structure 13. Note that the sensor 95 is shown for example on the cabinet 20 and the sensor 95 is shown for example on the drawer structure 13, however, the sensor may be provided on the drawer structure and magnet may provided on the cabinet, or the sensor and magnet may be provided on other suitable structures and arranged to interface with one another to provide "stop" and/or "start" points or other indications/signals for control of the opening and/or closing the drawer structure. For example, when opening of the drawer structure 13 is desired, the activation system receives an input and initiates a drive system 99 and the sensor 95 detects the initial movement of the magnet 97 away from the sensor 95, which may provide a signal to the display device 49 to indicate position of the drawer structure 13 and may also initiate operation of a drive system 99 (if movement of the extendable portion was manually initiated) to move the drawer structure 13 from a closed position to an open position. (see FIG. 25). As the drawer structure 13 approaches the open position, another magnet (not shown) may approach the sensor 95, which then initiates a signal (e.g. a stop point) to terminate movement of the drawer structure 13. Movement of the drawer structure from the open position to the closed position may also operate in a reverse manner. For example, upon activation the drive system 99 moves the drawer structure 13 toward the closed position, which is detected by the sensor as the (second) magnet moves away from the sensor 95 (and initiates operation of the drive system if manually activated) in a closing direction until sensor 95 detects the approach of magnet 97, such that the field of the magnet detected at the sensor indicates that the extendable portion has reached the desired position, such as the closed position (another stop point), which may correspond to any particular position (e.g. compression of a gasket between the extendable portion and the cabinet, etc.). Also, a change in resistance or other suitable indication can be used to determine the stop points. According to the illustrated embodiment in FIG. 25, a motor-driven drive screw system 99 is employed to move the drawer structure 13 open and closed (however, any suitable drive system such as a motor with a wire, cable, pulleys, etc. can be used). According to an alternative embodiment, a switch (or other suitable device such as light-beam sensors, resistive or inductive touch pads, etc.) can be used to operate the drawer structure and may be located on the unit or it can be remotely located for ease of operation and use, and can be operable to energize any suitable drive device for extending and retracting the drawer structure. According to other alternative embodiments, any suitable sensors and signals may be used to initiate opening or closing of the drawer structure. For example, the signal may be a sound, a voice, a noise signal (e.g. clapping or banging, etc.) interrupting a steady state condition; interrupting a beam of visible light or non-visible light; touching a surface which resistance increases or decreases providing a signal to a sensor for activation; force activation by pushing on the door front; and by a remote control signal such as a hand held control using a radio frequency or light beam, cooperating with suitable sensors. These and other methods can be used to activate the drive system for opening and closing the drawer structure of the non-food warmer drawer. By providing an activation system cooperating with a drive system responsive to selected stop points and start points, a user has the ability to actuate the extendable portion (e.g. by touch, interruption of a signal, switch operation, etc.), to which the warmer drawer 10 responds by opening and providing access to the drawer structure 13 and chamber 21 without having to manually pull or push the drawer structure throughout its travel range to access the objects. According to another embodiment, the activation system may detect an increase in resistance as the motor of the drive system 99 approaches (or reaches) the stop point and provide an output signal to stop the motor (or reverse the direction of the motor, or other desirable control action). According to a further embodiment, a stepper motor may be provided so that the number of turns can be counted by the activation system to determine the stop point and provide an appropriate output signal to control operation of the drawer structure.

According to any exemplary embodiment, the non-food warmer drawer as shown and described herein in intended for use in any suitable facility or room, such as commercial establishments (e.g. a restaurant, a resort, a spa, a club, a hotel, a pool, a salon, etc.) or institutional establishments (e.g. hospitals or other patient care facilities) or in residential applications (e.g. a bathroom, a kitchen, a dining room, an outdoor recreation center, pool-side patio, etc.) or any other suitable location selected by the user.

According to any exemplary embodiment, a warmer drawer is also disclosed for use in stationary or mobile applications in any desirable environment and is provided with an electronic control system that permits control based on user inputs from a user interface arid/or pre-programmed options that permit a user to operate the non-food warmer drawer with "the push of a button." The control system interfaces with a heating system (having one or more heating elements within the chamber or remote from the chamber, and that receive electrical power in a continuously variable and regulated manner to provide precise temperature control within a chamber), a ventilation system (including an air flow device such as a variable speed fan/motor, and a variably positionable damper/vent device driven by an actuator for air, heat and/or humidity control), a user interface (locally-controlled or remote-controlled) to permit a user to control the operation of the warmer drawer in a simple and convenient manner, and a display device arranged to provide information to a user (e.g. in the form of alpha-numeric text messages (stationary or scrolling) and/or graphic images, etc.).

The construction and arrangement of the elements of the non-food warmer drawer as shown in the illustrated and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, circuit form, type and interaction, use of sensors, etc.) without materially departing from the novel teachings and advantages of the subject matter recited herein. For example, elements shown as integrally formed may be constructed of multiple parts or elements, the position of elements may be reversed or otherwise varied, and the nature or number of discrete elements or positions may be altered or varied. Other substitutions, modifications, changes and omissions may be made in the design, operating conditions and arrangement of the preferred and other exemplary embodiments without departing from the scope of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A non-food warmer apparatus, comprising: an enclosure defining a chamber and having an opening; a drawer structure extendable from the chamber and movably coupled to the enclosure by guide members; at least one support structure coupled to the drawer structure and configured to hold non-food objects within the chamber; a heating element configured to provide heat to the chamber; a ventilation system operable to move air within the chamber; at least one sensor configured to provide a signal representative of a condition within the chamber; a user interface capable of receiving an input from a user and generating an output; an electronic control system operable to receive the signal representative of a condition within the chamber and the output from the user interface and to control operation of the heating element and the ventilation system; and a drive system operable to move the drawer structure between positions; and a heating element integrated with the support member to promote warming of the objects.

2. The non-food warmer apparatus of claim 1 wherein the electronic control system comprises a positive temperature coefficient of resistance controller.

3. The non-food warmer apparatus of claim 1 wherein the user interface comprises a touch pad device having a plurality of input elements.

4. The non-food warmer apparatus of claim 3 wherein the touch pad device comprises an operating technology selected from the group consisting of a piezo electric device, a capacitance device, an inductive device, a resistance device, an infrared device, a high frequency pad-less soft touch device, a pad-less touch digital encoder, a magnetic switch, a field effect device, a charge transfer device, a hall effect device, a transistor, and a micro encoder.

5. The non-food warmer apparatus of claim 3 wherein the touch pad device comprises a membrane switch.

6. The non-food warmer apparatus of claim 3 wherein the input elements comprise at least one preprogrammed operating functions.

7. The non-food warmer apparatus of claim 3 wherein the preprogrammed operating functions include at least one of a preprogrammed time and a preprogrammed temperature stored in a microprocessor of the electronic control system and selectable by a user through one of the input elements on the user interface.

8. The non-food warmer apparatus of claim 1 wherein the user interface is operable remotely from the enclosure to permit a user to control operation of the warmer apparatus from a remote location.

9. The non-food warmer apparatus of claim 1 wherein the at least one sensor comprises a sensor selected from the group consisting of a temperature sensing device, a humidity sensor and an infrared temperature sensing device and the condition is at least one of a temperature and a humidity in the chamber.

10. The non-food warmer apparatus of claim 9 wherein the temperature sensing device is selected from the group consisting of a thermostat, a thermal protector, a thermal cutoff, a thermal switch, a thermocouple, a PCB thermostat, a time delay relay, a bulb and capillary device, a cold control, a bimetallic device, a pressure switch, resistance temperature detector, a snap action switch, and a thermistor.

11. The non-food warmer apparatus of claim 1 further comprising a display device configured to provide information to a user.

12. The non-food warmer apparatus of claim 11 wherein the display device comprises a display panel having technology selected from the group consisting of light emitting diodes, liquid crystal display, plasma, dot matrix, and vacuum fluorescent display.

13. The non-food warmer apparatus of claim 11 wherein the display device is integrated with the user interface.

14. The non-food warmer apparatus of claim 1 wherein the ventilation system comprises a fan configured to circulate air within the chamber.

15. The non-food warmer apparatus of claim 1 wherein the ventilation system comprises a plurality of vent apertures in the enclosure and a variably positionable damper to regulate a flow of air through the vent apertures.

16. The non-food warmer apparatus of claim 15 further comprising a vent actuator operable to position the damper in response to a signal from the electronic control system.

17. The non-food warmer apparatus of claim 16 wherein the vent actuator comprises at least one of a solenoid drive device, a screw drive device, a gear drive device, a motor driven device, a cylinder driven device, a biasing member, a bi-metal device, an electromagnetic device and an electronically actuated device.

18. The non-food warmer apparatus of claim 15 wherein the vent apertures are located proximate a top of the enclosure and a fan is located proximate a bottom of the enclosure and configured to draw air into the chamber through the vent apertures.

19. The non-food warmer apparatus of claim 1 wherein the enclosure comprises a door and the ventilation system comprises a plurality of vent apertures in the door.

20. The non-food warmer apparatus of claim 1 wherein the door comprises an inside panel and an outside panel and the vent apertures are arranged for flow of air between the inside panel and the outside panel.

21. The non-food warmer apparatus of claim 1 wherein the support structure comprises an elongated member having a cross sectional shape selected from the group consisting of an inverted V, a Y, an X, and a U.

22. The non-food warmer apparatus of claim 1 wherein the support structure comprises a plurality of perforations.

23. The non-food warmer apparatus of claim 1 wherein the support structure comprises at least one of a pan and a rack.

24. The non-food warmer apparatus of claim 1 wherein the user interface is rotatably coupled to the enclosure for movement between a use position and a concealed position.

25. The non-food warmer apparatus of claim 1 wherein the user interface comprises a remote control device.

26. The non-food wanner apparatus of claim 1 further comprising a door pivotally coupled to the enclosure that when opened permits extension of the drawer structure.

27. A non-food warmer apparatus, comprising: an enclosure defining a chamber and having an opening; a drawer structure extendable from the chamber and movably coupled to the enclosure by guide members; at least one support structure coupled to the drawer structure and configured to hold non-food objects within the chamber; a heating element configured to provide heat to the chamber; a ventilation system operable to move air within the chamber; at least one sensor configured to provide a signal representative of a condition within the chamber; a user interface capable of receiving an input from a user and generating an output; an electronic control system operable to receive the signal representative of a condition within the chamber and the output from the user interface and to control operation of the heating element and the ventilation system; a drive system operable to move the drawer structure between positions; and a door capable of sliding into the enclosure.

28. An electronically controlled non-food warmer apparatus, comprising: an enclosure having sides and a top and a bottom defining a chamber; a drawer structure having at least one support member to support objects thereon, the drawer structure coupled to the enclosure for movement between a retracted position to warm the objects within the chamber and an extended position at least partially external to the chamber to permit access to the objects by a user; a heating system operable to heat the chamber; a ventilation system operable to move air through the chamber; a user interface having a plurality of inputs configured to control at least one of a temperature and a humidity within the chamber; a detection system configured to detect a condition within the chamber and provide a signal representative of the condition; and an electronic control system coupled to the enclosure and interfacing with the heating system and the ventilation system and the user interface and the display device so the objects in the chamber can be maintained at a desired temperature; wherein the heating system includes a heating element integral with the support member.

29. The non-food warmer apparatus of claim 28 further comprising a drive system operable to position the drawer structure within a travel range between the retracted position and the extended position.

30. The non-food warmer apparatus of claim 29 wherein the drive system comprises a screw drive system.

31. The non-food warmer apparatus of claim 30 wherein the electronic control system interfaces with sensors that detect a stop point and transmit a control signal to the drive system.

32. The non-food warmer apparatus of claim 28 further comprising a container communicating with the chamber and configured to receive an aromatic material capable of imparting a scent to the objects.

33. The non-food warmer apparatus of claim 28 further comprising a mobile pedestal coupled to the enclosure.

34. The non-food warmer apparatus of claim 28 wherein the ventilation system comprises a variable speed fan controlled by the electronic control system and operable to move air within the chamber.

35. The non-food warmer apparatus of claim 28 wherein the ventilation system comprises apertures formed in at least one of the sides, the top and the bottom, and a damper device operable to increase ventilation in the chamber by uncovering the apertures and operable to decrease ventilation in the chamber by covering the apertures.

36. The non-food warmer apparatus of claim 35 wherein the apertures are formed in the top and the heating system comprises at least one heating element positioned adjacent to the apertures.

37. The non-food warmer apparatus of claim 28 wherein the heating element comprises a ceramic heating device.

38. The non-food warmer apparatus of claim 28 wherein the electronic control system comprises at least one preprogrammed temperature set point and at least one time duration for selection on the user interface by a user.

39. The non-food warmer apparatus of claim 28 wherein the detection system comprises at least one of a temperature sensor, a humidity sensor and an infrared temperature sensor.

* * * * *